US012358711B2

(12) United States Patent
Tollefsbol et al.

(10) Patent No.: US 12,358,711 B2
(45) Date of Patent: Jul. 15, 2025

(54) MULTI-VESSEL INSULATOR AND CARRIER

(71) Applicant: GSI Outdoors, Inc., Spokane, WA (US)

(72) Inventors: Trevor Tollefsbol, Couer D'Alene, ID (US); Ian Scott, Spokane Valley, WA (US); Kurt Gauss, Spokane, WA (US); Don Scott, Spokane, WA (US); Tom Hathaway, Spokane, WA (US)

(73) Assignee: GSI Outdoors, Inc., Spokane, WA (US)

( * ) Notice: Subject to any disclaimer, the term of this patent is extended or adjusted under 35 U.S.C. 154(b) by 0 days.

(21) Appl. No.: 18/073,963

(22) Filed: Dec. 2, 2022

(65) Prior Publication Data

US 2023/0174292 A1 Jun. 8, 2023

Related U.S. Application Data

(60) Provisional application No. 63/285,356, filed on Dec. 2, 2021.

(51) Int. Cl.
*B65D 81/38* (2006.01)
*B65D 51/14* (2006.01)

(52) U.S. Cl.
CPC ..... *B65D 81/3881* (2013.01); *B65D 51/14* (2013.01)

(58) Field of Classification Search
CPC ..... B65D 81/3881; B65D 81/3883; B65D 81/3886; B65D 81/3888; B65D 81/389; B65D 81/3893; B65D 81/3895; B65D 81/3897; B65D 81/3879; B65D 81/3876; B65D 51/14
See application file for complete search history.

(56) References Cited

U.S. PATENT DOCUMENTS

| | | | | |
|---|---|---|---|---|
| 4,720,023 A * | 1/1988 | Jeff | B65D 81/3876 220/592.17 |
| 10,005,608 B1 * | 6/2018 | Jacob | B65D 81/3881 |
| 2018/0242765 A1 * | 8/2018 | Rane | A47G 23/0266 |
| 2019/0263564 A1 * | 8/2019 | Robertaccio | B65D 25/10 |

* cited by examiner

*Primary Examiner* — Javier A Pagan
(74) *Attorney, Agent, or Firm* — Randall Danskin P.S.

(57) ABSTRACT

An apparatus for containing, positioning and thermally insulating plural axially aligned beverage containers provides an elongate body, a retention collar that is threadably engaged with the body, a handle carried by the body and a puck that is movable, by a user, between a first position adjacent to an opening of the body and a second position adjacent to an interior bottom surface of the body.

16 Claims, 15 Drawing Sheets

MULTI-VESSEL INSULATOR AND CARRIER

RELATED APPLICATION(S)

This application claims priority pursuant to 35 U.S.C. 119(e) to U.S. Provisional Patent Application Ser. No. 63/285,356, filed Dec. 2, 2021, the entire disclosure of which is incorporated herein by reference.

TECHNICAL FIELD

This invention relates to thermal insulation of beverage containers, and more particularly to a device for thermally maintaining temperature of plural axially aligned beverage containers.

BACKGROUND

Beverage container insulators, commonly referred to as "cozies", "coozies" or even "koozies" are widely used to provide thermal insulation for beverage containers, such as cans and bottles. Such insulators generally frictionally axially slide over the beverage container to hold the beverage container, and also to provide an insulating exterior surface, to insulate the beverage container from ambient temperatures, and the consumers hand/fingers, and thus slowing the rate of heat transfer between the ambient environment/hands/fingers and the beverage container.

A typical "cozie", "coozie" or "koozie" holds a single beverage container, commonly a conventional 12-ounce can. There are occasions, however, when the consumer wishes to consume, or have immediate access to, a greater volume of a contained beverage. For example, a consumer may be moving about at the beach, or in some other locale, and may not be near a convenient cooler, or refrigerator. The consumer may wish to keep that greater volume of contained beverage cool without the inconvenience of carrying an additional container, insulator or thermos.

In addition, a consumer may wish to re-seal a beverage container that has been opened, and perhaps partially consumed, so as to prevent spillage and to preserve the beverage for later consumption.

SUMMARY

Our apparatus for containing, positioning and thermally insulating plural axially aligned beverage containers generally provides an elongate body 10, a retention collar 30 that is threadably engaged with the body 10, a handle 50 carried by the body 10 and a puck 60 that is movable, by a user, between a first position adjacent to an opening of the body 10 and a second position adjacent to an interior bottom surface 26 of the body 10.

A principal aspect of the present invention is an apparatus for containing, positioning and thermally insulating plural axially aligned beverage containers, the apparatus comprising: a body 10 that is elongate and has a first end portion 11, a second end portion 12, an exterior diameter 23, and an opening 18 defined at the first end portion 11 and a closed bottom 19 at the second end portion 12. The body 10 further defines an axial tubular chamber 20 that defines an interior diameter 21 and a length 22 between the opening 18 and an interior surface 26 of the closed bottom 19. Threads 24 are defined in an outer circumferential surface 14 of the body 10 at the first end portion 11. A retention collar 30 is threadably engaged with the threads 24 defined in the first end portion 11 of the body 10, and the retention collar 30 further defines an axially aligned hole 36 that has an interior diameter 39 that is smaller than the diameter 21 of the tubular chamber 20. A handle 50 is carried on the outer circumferential surface 14 of the body 10. A puck 60 that is movable, by a user, between a first position in the tubular chamber 20 adjacent to the opening 18, and a second position in the tubular chamber 20 adjacent to the interior bottom surface 26. The puck 60 has a body 61 that has a first top portion 62 that has an upper gasket compressing ledge 69, and an interconnected second bottom portion 80 that has a lower gasket compressing ledge 85, and a compressible gasket 105 is carried between the upper gasket compressing ledge 69, and the lower gasket compressing ledge 85. The first top portion 62 is movable relative to the second bottom portion 80 which responsively compresses the compressible gasket 105 and causes the compressible gasket 105 to expand radially outwardly so as to frictionally engage with an inner circumferential surface 16 of the tubular chamber 21 to positionally secure the puck 60 in an operator desired position.

A further aspect of the present invention is an apparatus for containing, positioning and thermally insulating plural axially aligned beverage containers, wherein the first top portion 62 of the puck 60 is axially movable relative to the second bottom portion 80 of the puck 60 to cause the compressible gasket 105 to expand radially outwardly; and the movement of the first top portion 62, relative to the second bottom portion 80 is responsive to axial twisting, and engagement of mating threads defined in the first top portion 62 and the second bottom portion 80.

A further aspect of the present invention is an apparatus for containing, positioning and thermally insulating plural axially aligned beverage containers, wherein the first top portion 62 of the puck 60 is axially movable relative to the second bottom portion 80 of the puck 60, to cause the compressible gasket 105 to expand radially outwardly; and the axial movement of the first top portion 62, relative to the second bottom portion 80, is responsive to actuation of a cam lever 95.

A further aspect of the present invention is an apparatus for containing, positioning and thermally insulating plural axially aligned beverage containers, wherein the handle 50 has a first end 51 that is secured to the outer circumferential surface 14 of the outer wall 13 body 10 proximate to the first end portion 11, and the handle 50 has a second end 52 that is secured to the outer circumferential surface 14 of the outer wall 13 body 10 proximate to the second end portion 12. And the handle 50 has a medial portion 53 between the first end 51 and the second end 52, and the medial portion 53 is resiliently flexible, and can be displaced radially relative to the outer circumferential surface 14 of the body 10.

A further aspect of the present invention is an apparatus for containing, positioning and thermally insulating plural axially aligned beverage containers and further comprising: an outer wall 13 of the body 10 defining an outer circumferential surface 14 and an exterior diameter 23; and an inner wall 15 of the body 10 defining an inner circumferential surface 16; and a void 17 between the outer wall 13 and the inner wall 15.

A further aspect of the present invention is an apparatus for containing, positioning and thermally insulating plural axially aligned beverage containers, and further comprising: insulation 25 in the void 17 between the outer wall 13 and the inner wall 15.

A further aspect of the present invention is an apparatus for containing, positioning and thermally insulating plural axially aligned beverage containers, and further comprising:

a radially inwardly extending lip 37; and a radially inwardly extending flexible wiper 39 both carried by the retention collar 30 and both within the axially aligned hole 36.

A further aspect of the present invention is an apparatus for containing, positioning and thermally insulating plural axially aligned beverage containers, and further comprising: a fluid sealing gasket 88 carried on a bottom exterior surface 81 of the second bottom portion 80 of the puck 60 to fluidically seal a beverage container that is immediately adjacent to the bottom exterior surface 81.

A further aspect of the present invention is an apparatus for containing, positioning and thermally insulating plural axially aligned beverage containers, and further comprising: a rigid sleeve 120 to positionally align and positionally maintain two beverage containers relative to one another, and wherein the sleeve 120 is tubular in configuration, the rigid sleeve 120 having a body 121 with a first end portion 122, a second end portion 123, an outer wall 124 having an outer circumferential surface 125, and defining a tubular chamber 129 that has an inner circumferential surface 126 and defines an axial opening 127 at the first end portion 122, and a closed bottom 128 at the second end portion 123, the body 121 further having an exterior diameter 132. The tubular chamber 129 defines an interior diameter 130 and has an internal length 131. The exterior diameter 132 of the body 121 of the rigid sleeve 120 is less than the diameter 21 of the tubular chamber 20 of the body 10, so that the rigid sleeve 120 is axially receivable within the tubular chamber 20 of the body 10; and wherein the interior diameter 130 of the tubular channel 129 of the rigid sleeve 120 is slightly greater than a diameter of the plural beverage containers, so that the beverage containers may be slidably carried within the tubular channel 129 of the rigid sleeve 120; and wherein the exterior diameter 132 of the rigid sleeve 120, is greater than the diameter 39 of the axially aligned hole 36 defined in the retention collar 30, so that the retention collar 30 positionally maintains the rigid sleeve 120 within the tubular chamber 20 of the body 10.

A further aspect of the present invention is an apparatus for containing, positioning and thermally insulating plural axially aligned beverage containers, and further comprising: a flexible connector boot 140 that is generally tubular in configuration, the connector boot 140 having a body 141 with a first end portion 142 that defines an axial opening 147, a second end portion 143 that defines an axial opening 148, an outer wall 140 that defines an outer circumferential surface 145, and an exterior diameter 152, and a tubular channel 149 that extends between the axial opening 147 at the first end portion 142 and the axial opening 148 at the second end portion 143, the tubular channel 149 defining an interior diameter 150 and having a channel length 151, and plural spacedly arrayed radially inwardly extending webs 153 are carried on an inner circumferential surface 146 of the tubular channel 149 to frictionally engage with outer circumferential surfaces of each beverage container engaged within the respective axial opening 147, 148 of the connector boot 140, to positionally maintain the beverage containers relative to the connector boot 140; and wherein the exterior diameter 152 of the connector boot 140 is less than the interior diameter 21 of the tubular chamber 20 of the body 10, so that the plural axially aligned beverage containers that are positionally maintained by the connector boot 140, can be axially carried within the tubular chamber 20 of the body 10.

A further aspect of the present invention is an apparatus for containing, positioning and thermally insulating plural axially aligned beverage containers and further comprising: a flexible connector boot 140 that is generally tubular in configuration, the connector boot 140 having a body 141 with a first end portion 142 that defines an axial opening 147, a second end portion 143 that defines an axial opening 148, an outer wall 140 that defines an outer circumferential surface 145, and an exterior diameter 152, and a tubular channel 149 that extends between the axial opening 147 at the first end portion 142 and the axial opening 148 after the second end portion 143, the tubular channel 149 defining an interior diameter 150 and having a channel length 151, and plural spacedly arrayed radially inwardly extending webs 153 are carried on an inner circumferential surface 146 of the tubular channel 149 to frictionally engage with outer circumferential surfaces of axially aligned beverage containers that are simultaneously engaged within the axial openings 147, 148 of the connector boot 140, to positionally maintain the axially outlined beverage containers relative to the connector boot 140; and wherein the exterior diameter 152 of the connector boot 140 is less than the interior diameter 130 of the tubular chamber 129 of the rigid sleeve 120, so that the plural axially aligned beverage containers that are positionally maintained by the connector boot 140 can be axially movably carried within the tubular chamber 129 of the rigid sleeve 120.

A further aspect of the present invention is an apparatus for containing, positioning and thermally insulating plural axially aligned beverage containers, and further comprising a thermal gel carried within the void 17 between the outer wall 13 and the inner wall 15 of the body 10.

A further aspect of the present invention is an apparatus for containing, positioning and thermally insulating plural axially aligned beverage containers, and wherein the puck 60 may be positioned, proximate to the first end portion 11 of the body to secure the plural beverage containers within the tubular chamber 20, and the puck 60 may optionally be positioned within the tubular chamber 20 adjacent to the interior bottom surface 26 so that the plural beverage containers carried within the tubular chamber 20 are proximate to the first end portion 11 of the body, and are secured there-at by the retention collar 30, and a drink orifice defined in an upper-most beverage container is assessable to the user for dispensing of a beverage from within the uppermost beverage container.

A further aspect of the present invention is an apparatus for containing, positioning and thermally insulating plural axially aligned beverage containers and wherein the puck 60 is carried, at least partially, within the tubular chamber 20 of the body 10, and is movable by a user between a first position adjacent to the opening 18, of the body 10 and a second position adjacent to the interior bottom surface 26, the puck 60 having a body 61 that has a first top portion 62 and a second bottom portion 80 that is movable relative to the first top portion 62, responsive to actuation of a cam lever 95; and wherein, the first top portion 62 of the puck 60 has a top exterior surface 63, an opposing bottom interior surface 73, an outer circumferential edge 68 that defines an upper gasket compressing ledge 69. A cam lever hub 64 is carried on the top exterior surface 63 of the puck 60 and defines diametrically opposed cam anchor axle slots 65 so that the cam lever 95 may extend therethrough and be pivotally moved relative to the first top portion 62. The cam lever 95 is positioned within an annular shaped depression 67 defined in the top exterior surface 63 radially outwardly of the cam lever hub 64. The bottom interior surface 73 of the first top portion 62, defines a medial chamber 72, a cam anchor passage 71, and an alignment boss 70 that extends generally axially downwardly from the bottom interior surface 73 about the medial chamber 72, and the alignment boss 70 is tapered radially inwardly. The second bottom portion 80 of the puck 60 has a top interior surface 89, a bottom exterior surface 81, an outer circumferential edge 84 that defines a lower gasket compressing ledge 85, and a recess 82 is defined in the bottom exterior surface for a cam anchor 99. The second bottom portion 80 of the puck 60 defines a medial chamber 86 that opens upwardly toward the first top portion 62. The top interior surface 89 carries an annularly shaped, upwardly extending, radially inwardly tapered boss 87 that slidably axially cooperates with and aligns with the alignment boss 70 carried by the first top end portion 62, so that the first top portion 62 and the second bottom portion 80 are axially aligned relative to one another and are axially movable relative to one another. A spring 74 is carried in the medial chamber 86 to positionally bias the first top portion 62 and the second bottom portion 80 distally/away from one another. A compressible gasket 105 is carried by the puck 60 between the upper gasket compressing ledge 69 of the first top portion 62, and the lower gasket compressing ledge 85 of the second bottom portion 80. The cam anchor 99 has a first end portion 100, a second end portion 101, a generally planar anchor disc 102 at the second end portion 101, and an axially extending anchor post 103 that is interconnected with the anchor disc 102 to extend toward the first end portion 100. An end portion of the anchor post 103, opposite the disc 102 defines a cam engaging hook 104 that engages with a non-cylindrical (not cross-sectionally circular) cam axle 98 of the cam lever 95. The cam lever 95 is pivotally movable between a first position 110, and a second position 111, relative to the annular shaped depression 67 defined in the top exterior surface 63 and when the cam lever 95 is in the first position 110 the compressible gasket 105 positioned between the upper gasket compressing ledge 69, and the lower gasket compressing ledge 85 is not compressed, and the exterior diameter 78 of the puck 60 allows the puck 60 to move axially freely within the axially aligned tubular chamber 20. When the cam lever 95 is in the second position 111, the compressible gasket 105 positioned between the upper gasket compressing ledge 69 and the lower gasket compressing ledge 85 is compressed which responsively causes the compressible gasket 105 to expand radially outwardly to have a second diameter 76 that is greater than the first diameter 78 which positionally secures the puck 60 at a desired position within the axially aligned tubular chamber 20, and seals the axially aligned tubular chamber 20.

A still further aspect of the present invention is an apparatus for containing, positioning and thermally insulating plural axially aligned beverage containers, comprising: a body 10 that is elongate and generally cylindrical, having a first end portion 11, a second end portion 12, an outer wall 13 defining an outer circumferential surface 14 and defining an exterior diameter 23, an inner wall 15 defining an inner circumferential surface 16 and having a thermally insulated space 17 between the outer wall 13 and the inner wall 15. An axially aligned opening 18 is defined at the first end portion 11 of the body 10 and a closed bottom 19 is defined at the second end portion 12 of the body 10 spaced apart from the first end portion 11. The body 10 further defines an axially aligned tubular chamber 20 that defines an interior diameter 21, and a length 22 between the axially aligned opening 18 at the first end portion 11, and an interior surface 26 of the closed bottom 19 at the second end portion 12. Threads 24 are defined in the outer circumferential surface 14 of the outer wall 13 at the first end portion 11. A retention collar 30 that is annular in configuration has a first end portion 31, a second end portion 32, an outer circumferential surface 33 and an inner circumferential surface 34 and defines threads 35 that matingly engage with the threads 24 defined in the outer circumferential surface 14 of the body 10. The retention collar 30 further defines an axially aligned through hole 36 that defines an interior diameter 39 that is smaller than the diameter 21 of the axially aligned tubular chamber 20, and the axially aligned through hole 36 has a radially inwardly extending lip 37, and a radially inwardly extending flexible wiper 39. A handle 50 is carried on the outer circumferential surface 14 of the body 10. The handle 50 has a first end 51 that is secured to the outer circumferential surface 14 of the outer wall 13 of the body 10 proximate to the first end portion 11, and the handle 50 has the second end 52 that is secured to the outer circumferential surface 14 of the outer wall 13 of the body 10 proximate to the second end portion 12. The handle 50 further has a medial portion 53 between the first end 51 and the second end 52, and the medial portion 53 is resiliently flexible and can be displaced radially relative to the outer wall 13 of the body 10. A puck 60 is carried, at least partially, within the axially aligned tubular chamber 20 of the body 10, and is movable by a user between a first position adjacent to the opening 18, and a second position adjacent to the interior bottom surface 26. The puck 60 has a body 61 that defines an exterior diameter 78, and has a first top portion 62, a second bottom portion 80 that is movable relative to the first top portion 62, and a cam lever 95. The first top portion 62 of the puck 60 has a top exterior surface 63, an opposing bottom interior surface 73, an outer circumferential edge 68 that defines an upper gasket compressing ledge 69, and a cam lever hub 64 that is carried on the top exterior surface 63 and which defines diametrically opposed cam anchor axle slots 65 so that the cam lever 95 may extend therethrough and be pivotally moved relative to the first top portion 62. The cam lever 95 is positioned within an annular shaped depression 67 defined in the top exterior surface 63 radially outwardly of the cam lever hub 64. The bottom interior surface 73, of the first top portion 62, defines a medial chamber 72, a cam anchor passage 71, and an alignment boss 70 that extends generally axially downwardly from the bottom interior surface 73 about the medial chamber 72. The alignment boss 70 is tapered radially inwardly. The second bottom portion 80 of the puck 60 has a top interior surface 89, a bottom exterior surface 81, an outer circumferential edge 84 that defines a lower gasket compressing ledge 85, and a recess 82 defined in the bottom exterior surface for a cam anchor 99. The second bottom portion 80 of the puck 60 further defines a medial chamber 86 that opens upwardly toward the first top portion 62, and the top interior surface 89 carries an annularly shaped, axially upwardly extending, radially inwardly tapered boss 87 that slidably cooperates with, and aligns with, the alignment boss 70 carried by the first top end portion 62, so that the first top portion 62 and the second bottom portion 80 are axially aligned relative to one another, and are axially movable relative to one another. A spring 74 is carried in the medial chamber 86 to positionally bias the first top portion 62 and the second bottom portion 80 distally from one. A compressible gasket 105 is carried by the puck 60 between the upper gasket compressing ledge 69 of the first top portion 62, and the lower gasket compressing ledge 85 of the second bottom portion 80. The cam anchor 99 has a first end portion 100, a second end portion 101, a generally planar anchor disc 102 at the second end portion 101, and an axially extending anchor post 103 is interconnected with the anchor disc 102 and extends toward the first end portion 100. An end portion of the anchor post 103 opposite the anchor disc 102 defines a cam engaging hook 104 that engages with a non-cylindrical cam axle 98 of the cam lever 95. The cam lever 95 is pivotally movable between a first position 110 and a second position 111 relative to the annular shaped depression 67 defined in the top exterior surface 63 and when the cam lever 95 is in the first position 110, the compressible gasket 105 positioned between the upper gasket compressing ledge 69 and the lower gasket compressing ledge 85, is not compressed, and the exterior diameter 78 of the puck 60 allows the puck 60 to move freely axially within the axially aligned tubular chamber 20. When the cam lever 95 is in the second position 111, the compressible gasket 105 positioned between the upper gasket compressing ledge 69 and the lower gasket compressing ledge 85 is compressed which causes the compressible gasket 105 to expand radially outwardly to have a second diameter 76 that is greater than the first diameter 78 which positionally secures the puck 60 at a desired position within the axially aligned tubular chamber 20, and seals the axially aligned tubular chamber 20.

An even still further aspect of the present invention is an apparatus for containing, positioning and thermally insulating plural axially aligned beverage containers and wherein the length 22 of the axially aligned tubular chamber 20 of the body 10 is sufficient to fully enclose plural axially aligned beverage containers, and a portion of the puck 60.

These and other aspects of the present invention are more fully disclosed, as is required, herein.

BRIEF DESCRIPTIONS OF THE FIGURES

DETAILED DESCRIPTION OF THE PREFERRED EMBODIMENTS

Figure 1:
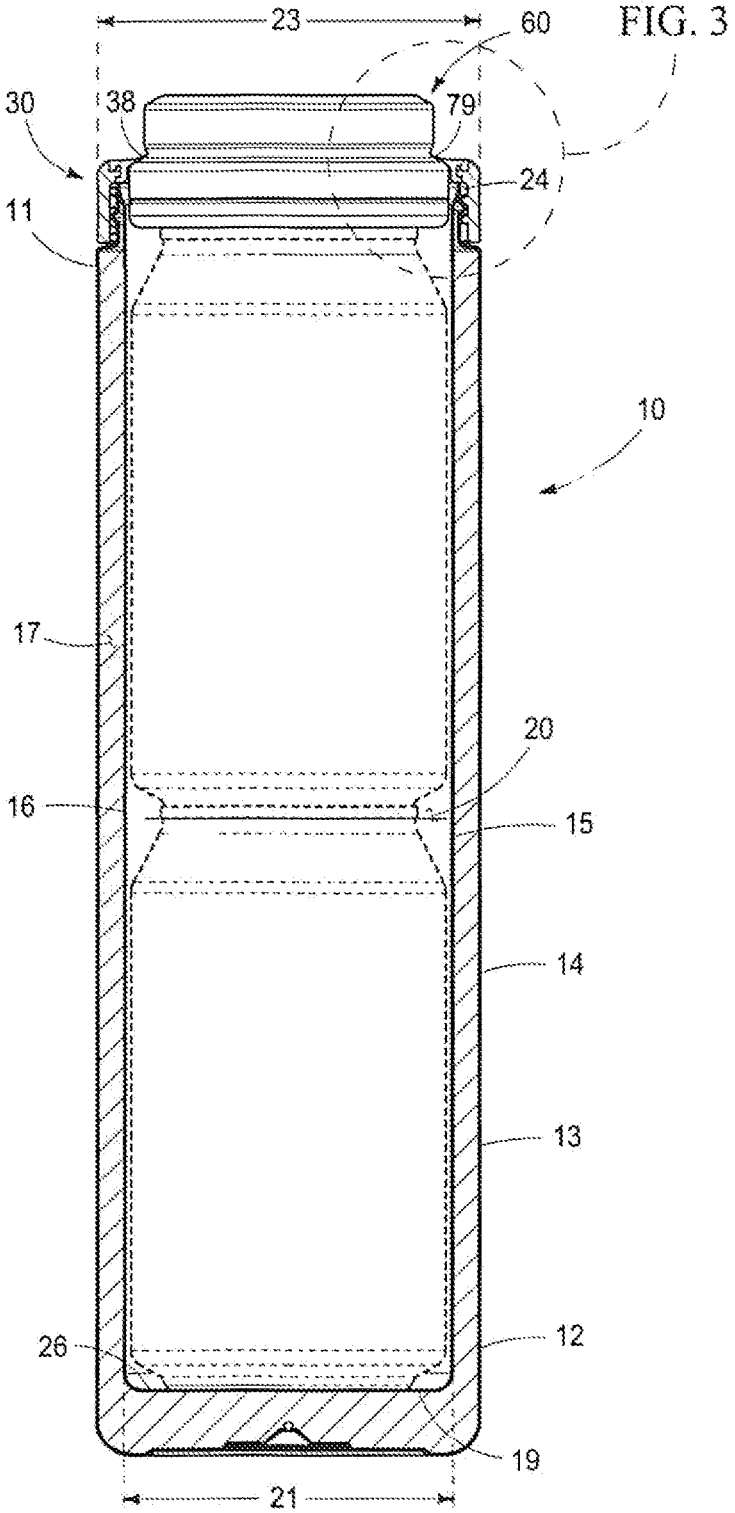
FIG. 1 is an orthographic, cross section, side view of the present invention showing (in dashed outline) two axially aligned beverage containers within the tubular chamber, and showing the puck at a first position and the retention collar threadably engaged with the body.

This disclosure of the invention is submitted in furtherance of the Constitutional purposes of the U.S. Patent Laws "to promote the progress of science and useful arts" (Article 1, Section 8).

Our apparatus for containing, positioning and thermally insulating plural axially aligned beverage containers generally provides an elongate body 10, a retention collar 30 that is threadably engaged with the body 10, a handle 50 carried by the body 10 and a puck 60 that is movable, between a first position adjacent to an opening of the body 10 and a second position adjacent to an interior bottom surface 26 of the body 10.

As shown in the Figures, the body 10 is elongate and generally cylindrical, and has a first end portion 11, a second end portion 12, an outer wall 13 defining an outer circumferential surface 14 and defining an exterior diameter 23. An inner wall 15 defines an inner circumferential surface 16 and a void 17 is between the outer wall 13 and the inner wall 15. An axially aligned opening 18 is defined at the first end portion 11 of the body 10 and a closed bottom 19 is defined at the second end portion 12 of the body 10 spaced apart from the first end portion 11. The body 10 further defines an axially aligned tubular chamber 20 that has an interior diameter 21, and a length 22 between the axially aligned opening 18 at the first end portion 11, and an interior surface 26 of the closed bottom 19 at the second end portion 12. Threads 24 are defined in the outer circumferential surface 14 of the outer wall 13 at the first end portion 11. The void 17 may contain and/or be at least partially filled with a thermally insulating material or gas such as, but not limited to, water, thermal gel, gas, vacuum, and/or air.

The retention collar 30 is generally annular in configuration and has a first end portion 31, a second end portion 32, an outer circumferential surface 33 and an inner circumferential surface 34 that defines threads 35 that matingly engage with the threads 24 defined in the outer circumferential surface 14 of the body 10 at the first end portion 11 thereof. The retention collar 30 further defines an axially aligned through hole 36 that has an interior diameter 39 that is smaller than the diameter 21 of the axially aligned tubular chamber 20 of the body 10. The axially aligned through hole 36 has a radially inwardly extending lip 37, and a radially inwardly extending flexible wiper 39. In some embodiments, the retention collar 30 is made of a rigid material, such as, but not limited to metal, plastic, ceramic, or glass. In some embodiments, the retention collar 30 is made of a flexible material, such as, but not limited to, rubber or elastomer.

Figure 4:
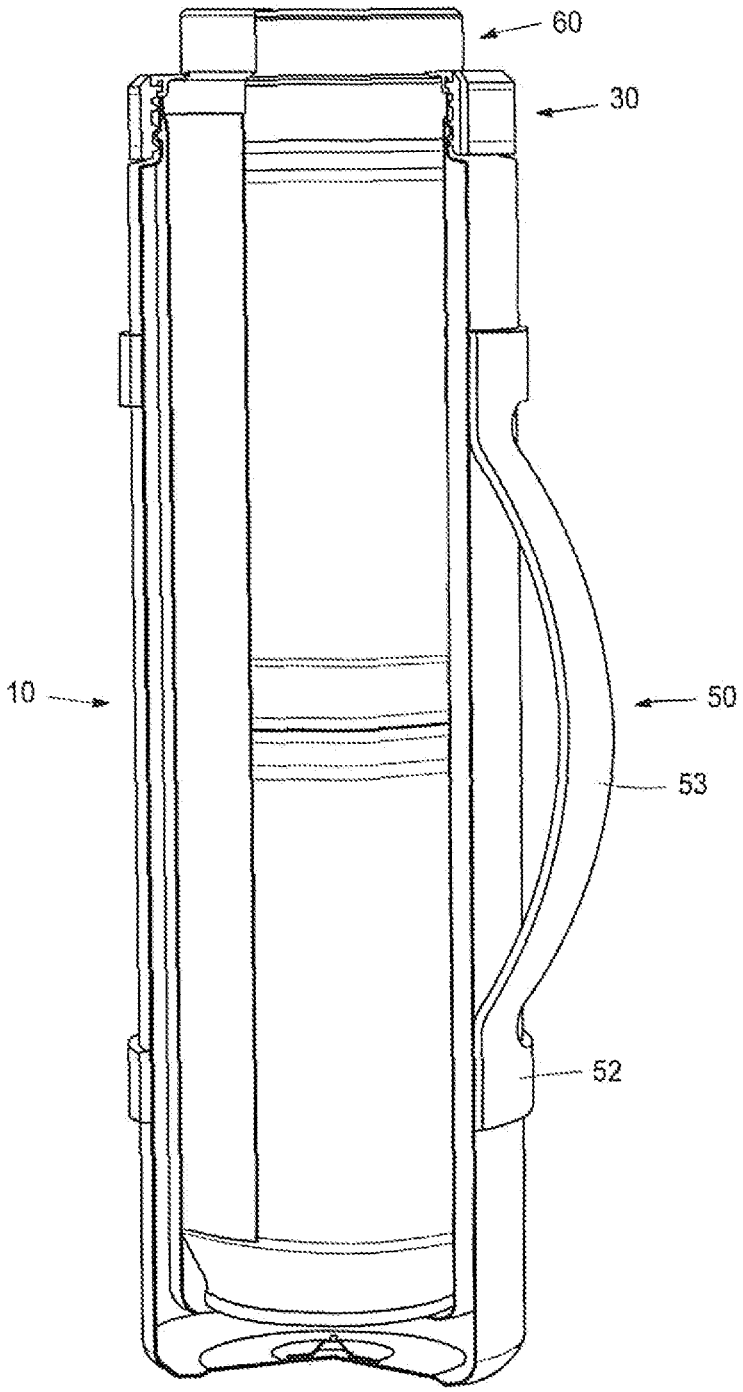
FIG. 4 is an orthographic, cutaway view of the present invention showing the two axially aligned beverage containers secured to one another with a tubular sleeve, and the beverage containers in a storage position and showing the puck at a first position and the retention collar threadably engaged with the body.
Figure 5:
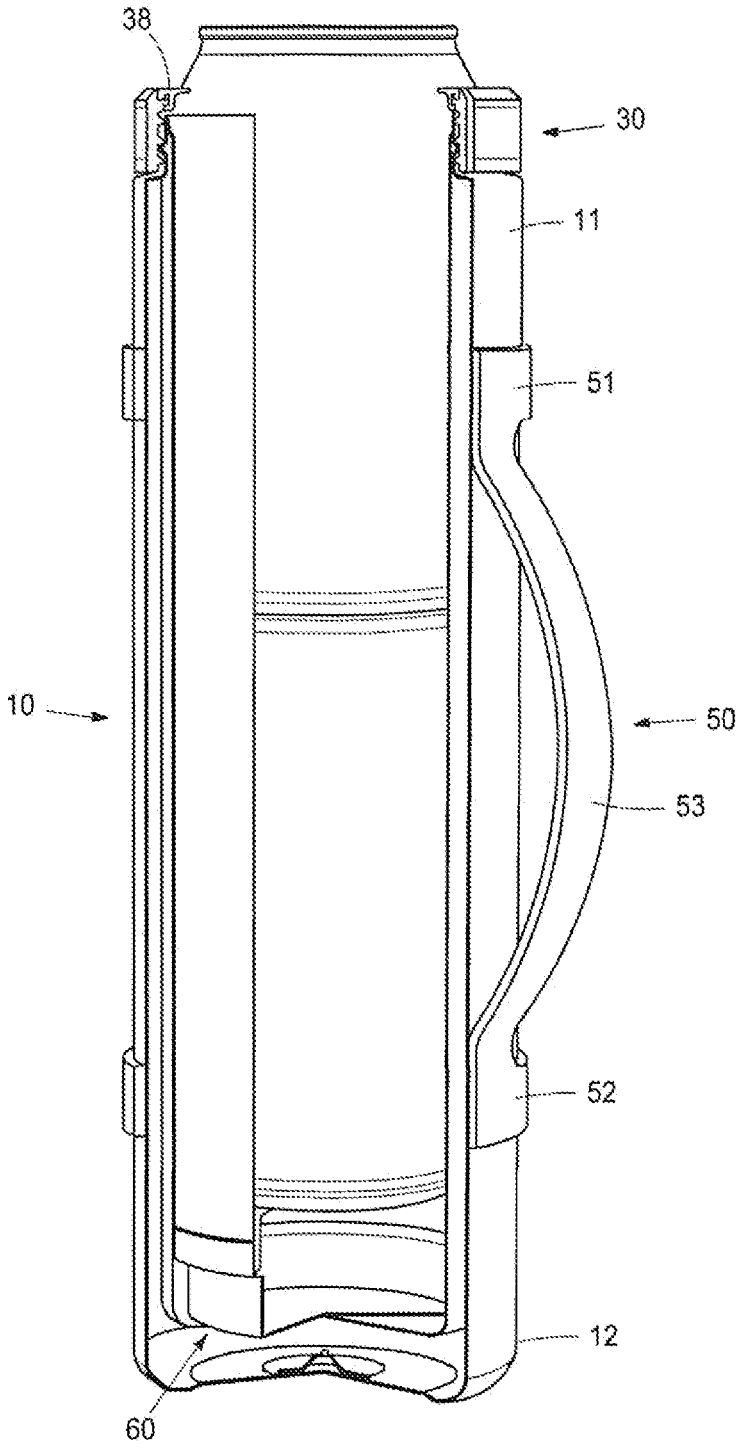
FIG. 5 is an orthographic, cutaway view, similar to that of FIG. 4, showing the beverage containers, and the tubular sleeve, inverted within the tubular chamber to be placed in a drinking/consumption orientation.

Best shown in FIGS. 4 and 5, a handle 50 may be carried on the outer circumferential surface 14 of the body 10. The handle 50 has a first end 51 that is secured to the outer circumferential surface 14 of the outer wall 13 of the body 10 proximate to the first end portion 11, and a second end 52 that is secured to the outer circumferential surface 14 of the outer wall 13 of the body 10 proximate to the second end portion 12. Further, the handle 50 has a medial portion 53 between the first end 51 and the second end 52, and the medial portion 53 is resiliently flexible so that it can be displaced radially relative to the outer wall 13 of the body 10. In some embodiments, the handle 50 is removable from the body 10 and may be attached thereto by means of straps, snaps, buckles, and similar attachments.

As shown in the Figures, the puck 60 may have a variety of configurations, but in some embodiments, the puck 60 is carried, at least partially, within the axially aligned tubular chamber 20 of the body 10, and the puck 60 is movable by a user between a first position (FIG. 1) adjacent to the opening 18 and the retention collar 30, and a second position (FIG. 2) adjacent to the interior bottom surface 26 and a lower portion of the axially aligned beverage containers.

Figure 2:
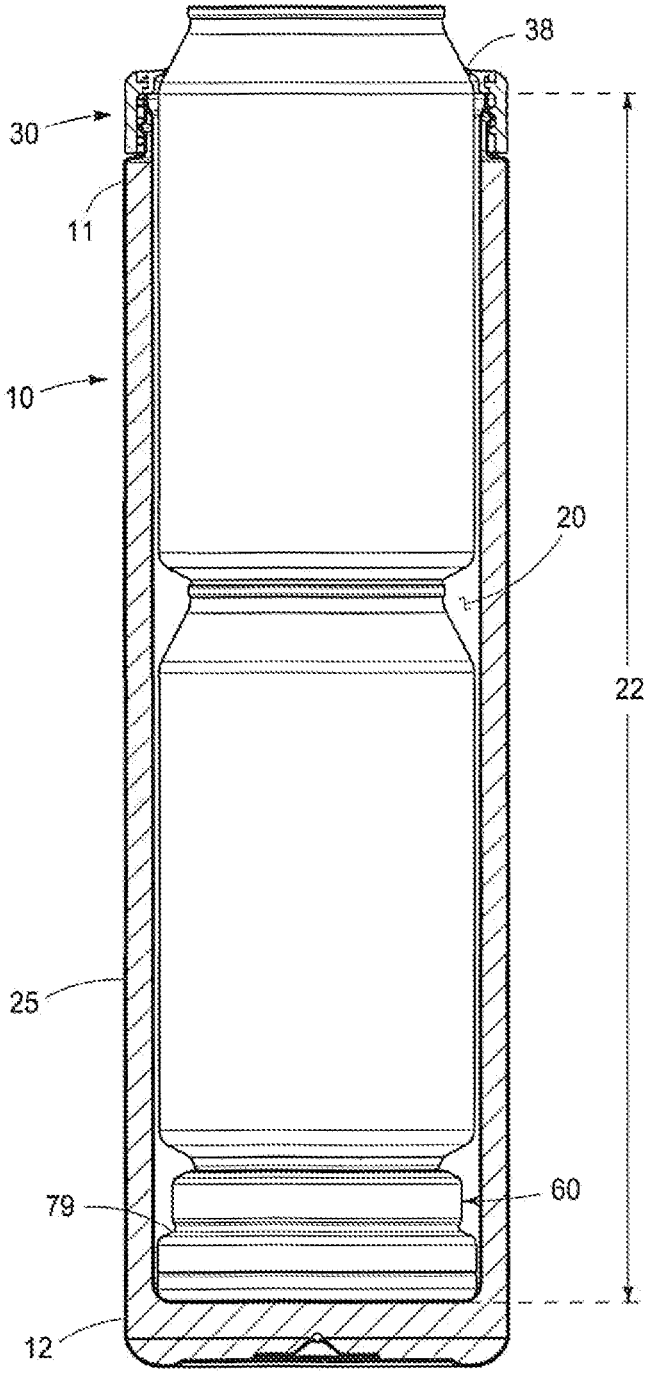
FIG. 2 is an orthographic cross section, side view, similar to that of FIG. 1, showing the puck at a second position and the upper most beverage container positioned for drinking/consumption by a user and retained in axial alignment by the retention collar.
Figure 3:
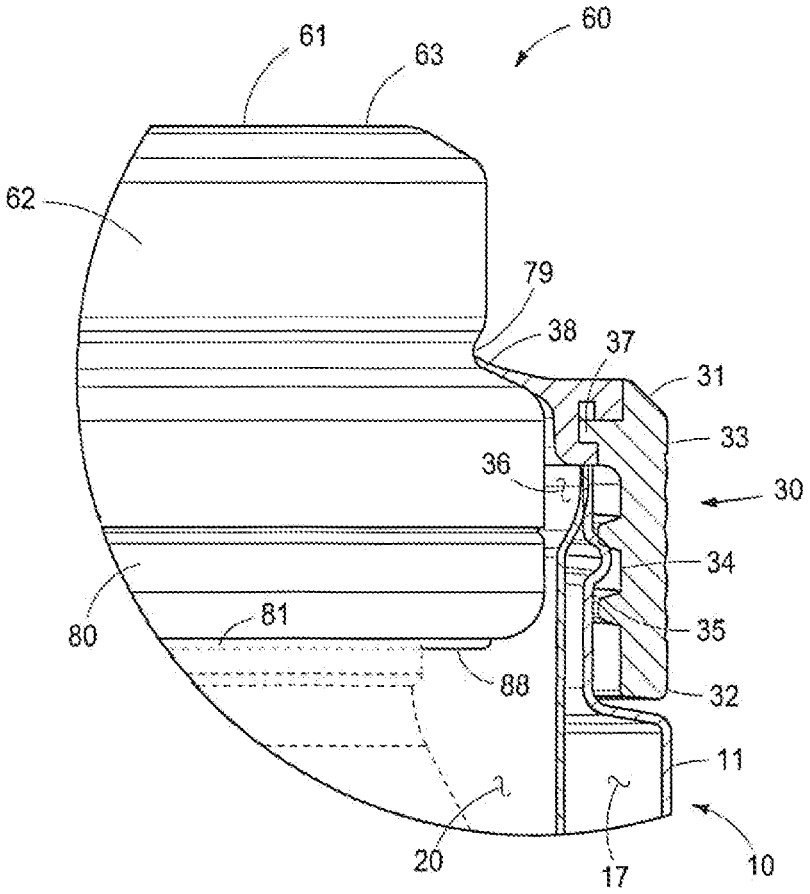
FIG. 3 is a partial enlarged view of FIG. 1, showing the threaded interconnection of the retention collar and puck at the opening of the body.

In some embodiments, shown in FIGS. 1-3, the puck 60 includes a top portion 62 and an opposing bottom portion 80 and the top portion 62 is stacked on the bottom portion 80 like layers of a wedding cake.

In some embodiments, shown in FIGS. 11-16, the puck 60 forms a fluid seal with the inner wall 15 of the body 10. The puck 60 is configured such that the top portion 62 and the bottom portion 80 are axially removable relative to one another by means of mating threads 66 and 89. The mating threads 66 and 89 are defined in adjacent surfaces of the top portion 62 and the bottom portion 80. A flexible compressible gasket 105 is positioned between the top portion 62 and the bottom portion 80.

In some embodiments, shown in FIGS. 11-17, the first top portion 62 of the puck 60 has a top exterior surface 63, an opposing bottom interior surface 73, an outer circumferential edge 68 that defines an upper gasket compressing ledge 69, and a cam lever hub 64 that is carried on the top exterior surface 63 and which defines diametrically opposed cam anchor axle slots 65 so that the cam lever 95 may extend therethrough and be pivotally movable relative to the first top portion 62. The first top portion 62 of the puck 60 defines the minor exterior diameter 77 and further defines an annular radially inwardly extending wiper engaging depression 79. The cam lever 95 is positioned within an annular shaped depression 67 defined in the top exterior surface 63 radially outwardly of the cam lever hub 64. The bottom interior surface 73, of the first top portion 62, defines a medial chamber 72, a cam anchor passage 71, and an alignment boss 70 that extends generally axially downwardly from the bottom interior surface 73 about the medial chamber 72. The alignment boss 70 is tapered radially inwardly.

The second bottom portion 80 of the puck 60 has a top interior surface 89, a bottom exterior surface 81, an outer circumferential edge 84 that defines a lower gasket compressing ledge 85, and a recess 82 is defined in the bottom exterior surface for a cam anchor 99. The second bottom portion 80 of the puck 60 further defines a medial chamber 86. The top interior surface 89 defines an annularly shaped, axially downwardly extending, radially inwardly tapered cavity 87 that slidably cooperates with, and aligns with, the alignment boss 70 carried by the first top end portion 62 of the puck 60, so that the first top portion 62 and the second bottom portion 80 are axially aligned relative to one another and are axially movable relative to one another.

A fluid sealing gasket 88 is carried on the bottom exterior surface 81 of the second bottom portion 80. The fluid sealing gasket 88 may be compressed against an immediately adjacent beverage container (FIG. 1) so as to fluidically seal the beverage container which may have been opened and/or partially consumed by a user.

Figure 15:
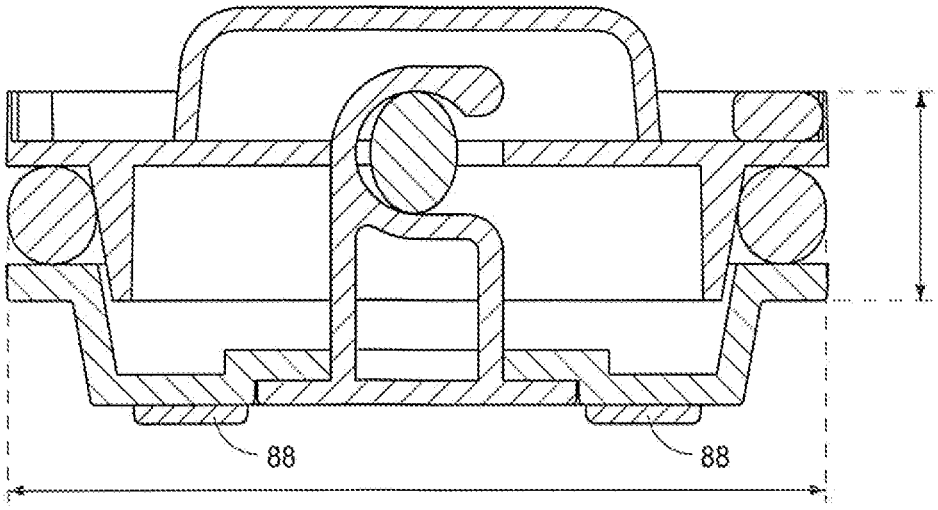
FIG. 15 is an orthographic, cross section, inverted side view of the puck, taken on line 15-15 of FIG. 17 showing the compressible O-ring in an uncompressed state.
Figure 16:
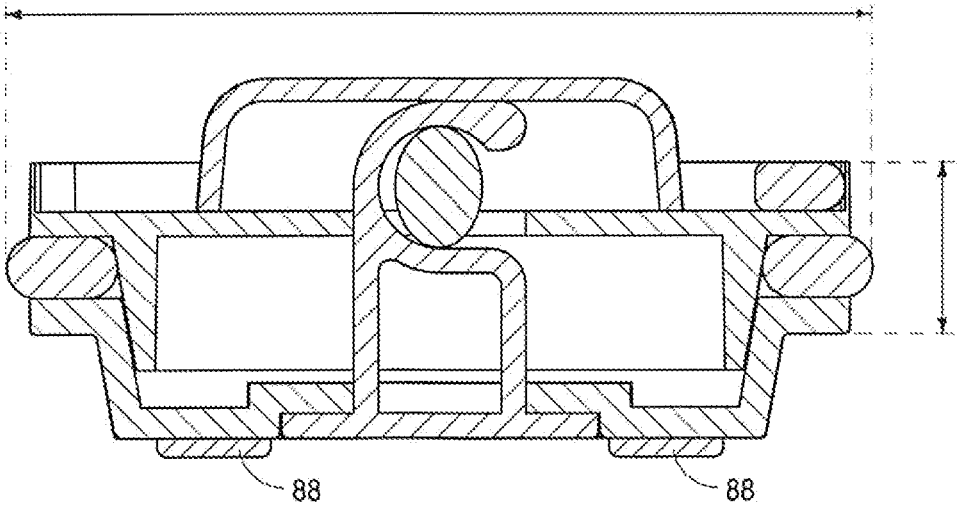
FIG. 16 is an orthographic, cross section, inverted side view similar to that of FIG. 15, showing the compressible O-ring in a compressed state.
Figure 17:
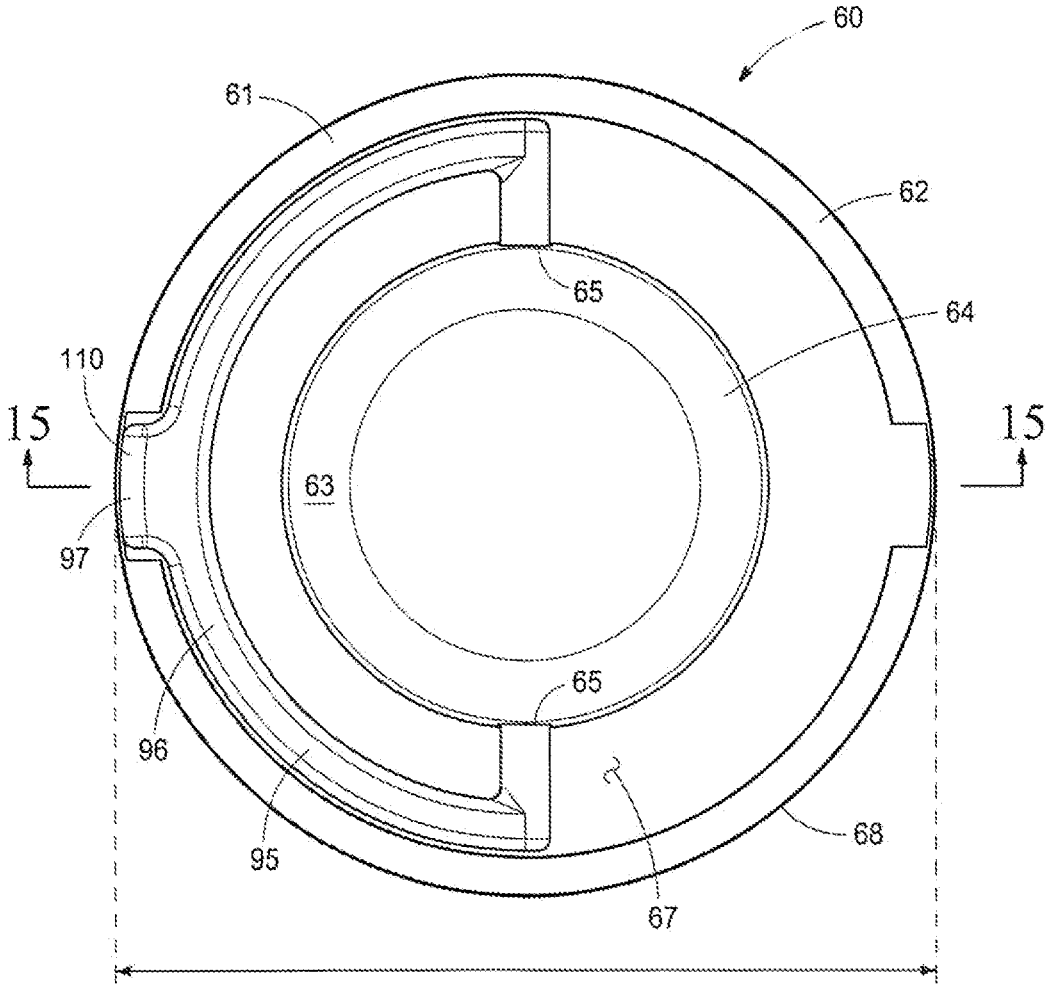
FIG. 17 is an orthographic, downward looking, plan view of the puck.

A compressible gasket 105 is carried by the puck 60 between the upper gasket compressing ledge 69 of the first top portion 62, and the lower gasket compressing ledge 85 of the second bottom portion 80. As shown in FIGS. 15 and 16, the compressible gasket 105 expands radially outwardly (responsively increasing the exterior diameter of the puck 60 from a first exterior diameter 78 to a larger second exterior diameter 76) when the first top portion 62 and the second bottom portion 80 are moved closer to one another responsive to actuation of the cam lever 95.

The puck 60 has a plurality of interconnected and generally axially aligned components including the cam axle hub 64, the cam lever 95, the first top portion 62, the compressible gasket 105, the second bottom portion 80 and the cam anchor 99. The cam lever 95 has a semi-circular handle 96 that has a locking protrusion 97 at a generally medial position thereon, and opposing end portions of the semi-circular handle 96 each interconnect with a cam axle 98 that is non-cylindrical (is not circular in cross section) so that pivotal movement of the cam lever 95 relative to the cam lever hub 64 of the puck 60 exerts a drawing force on the cam anchor 99. The cam anchor 99 has a first end portion 100, a second end portion 101, a generally planar anchor disc 102 at the second end portion 101, and an axially extending anchor post 103 that extends toward the first end portion 100. An end portion of the anchor post 103 opposite the disc 102 defines a cam engaging hook 104 that engages with a non-cylindrical (not cross-sectionally circular) cam axle 98 of the cam lever 95.

The cam lever 95 is pivotally movable between a first position 110, and a second position 111, relative to the annular shaped depression 67 defined in the top exterior surface 63 and when the cam lever 95 is in the first position 110, the compressible gasket 105 positioned between the upper gasket compressing ledge 69, and the lower gasket compressing ledge 85 is not compressed (FIG. 15), and the first exterior diameter 78 of the puck 60 allows the puck 60 to move freely axially within the axially aligned tubular chamber 20. In contrast, when the cam lever 95 is in the second position 111, the compressible gasket 105 between the upper gasket compressing ledge 69 and the lower gasket compressing ledge 85 is compressed (FIG. 16) which causes the fluid sealing gasket 88 to expand radially outwardly to have a second exterior diameter 76 that is greater than the first diameter 78. The larger second exterior diameter 76 positionally secures the puck 60 at a desired position within the axially aligned tubular chamber 20, and seals the axially aligned tubular chamber 20.

In some embodiments of the puck 60, (FIGS. 12-13) a spring 74 is carried within the medial chamber 86 to positionally bias the first top portion 62 and the second bottom portion 80 distally from one another. The biasing provided by the spring 74 exerts axial pressure on the beverage container immediately adjacent the puck 60 which responsively allows the fluid sealing gasket 88 carried on the bottom exterior surface 81 of the second bottom portion 80 to fluidically seal the adjacent beverage container to prevent leakage/spillage of the contents when the puck 60 is engaged therewith (FIG. 1).

The length 22 of the axially aligned tubular chamber 20 of the body 10 is sufficient to fully enclose plural axially aligned beverage containers and at least a portion of the puck 60.

Figure 9:
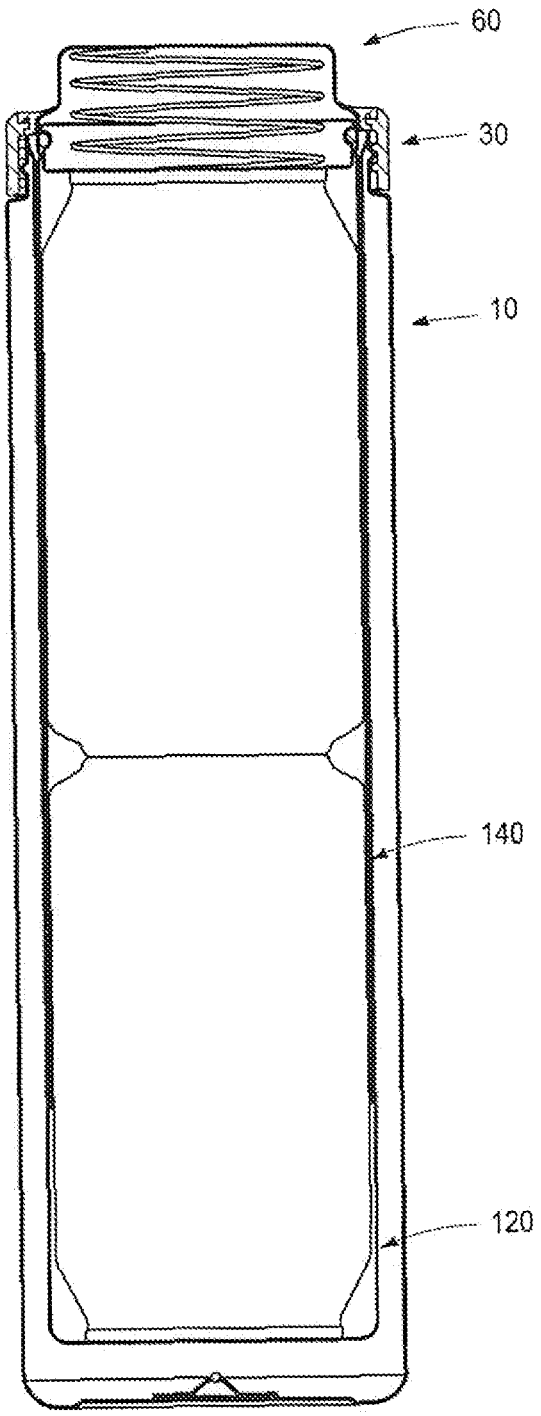
FIG. 9 is an orthographic, cross section, side view, similar to that of FIG. 8, showing the puck in the first position, sealing the medial chamber and fluidically sealing the upper most beverage container.
Figure 10:
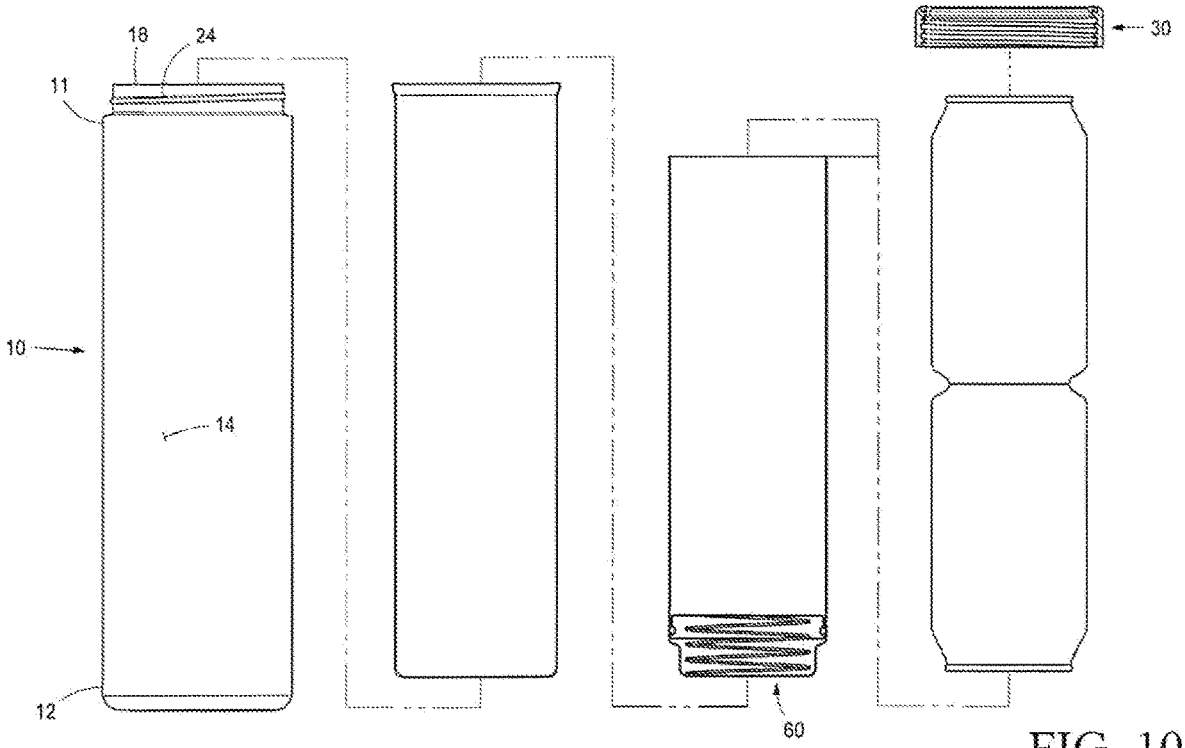
FIG. 10 is an exploded, orthographic side view of the various components of the invention, shown in FIG. 8.
Figure 11A:
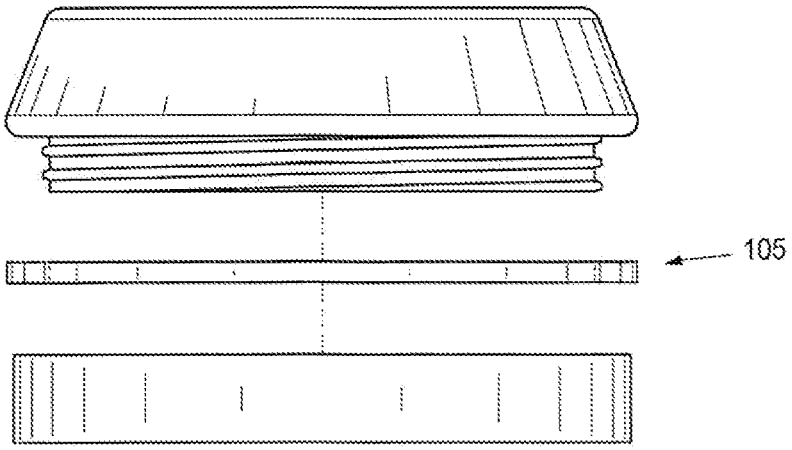
FIG. 11A is an exploded, orthographic side view of an embodiment of the puck showing a compressible gasket.
Figure 11B:
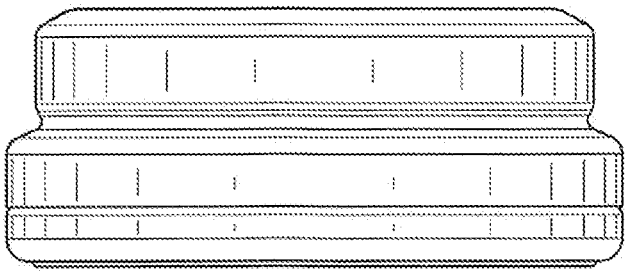
FIG. 11B is an orthographic side view of the puck of FIG. 11A, showing the puck in an assembled state.
Figure 12:
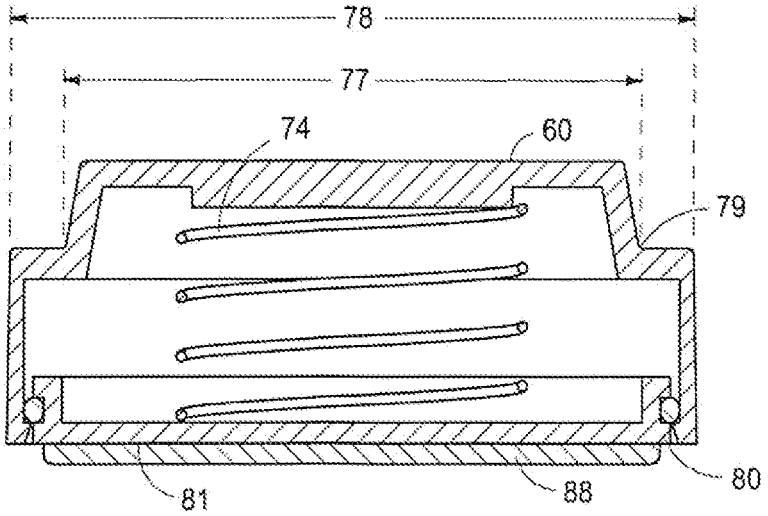
FIG. 12 is an orthographic, cross section, side view of an embodiment of the puck, showing the internal components thereof, in a first, uncompressed orientation.
Figure 13:
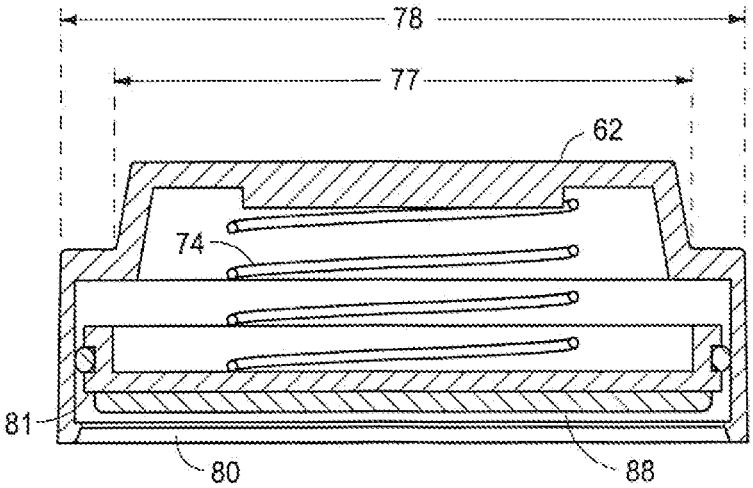
FIG. 13 is an orthographic, cross section side view of the puck, similar to FIG. 12, showing the puck in a second, compressed orientation.
Figure 14:
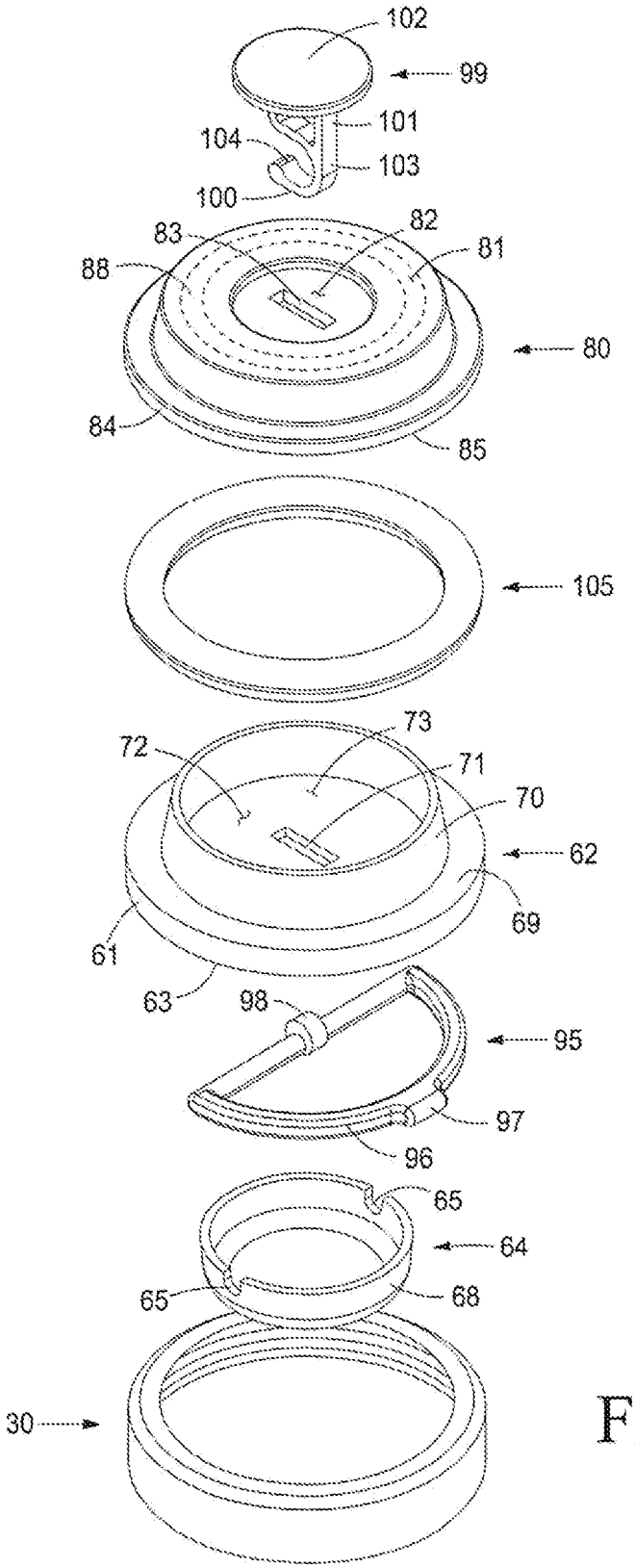
FIG. 14 is an inverted, exploded perspective view of the puck, showing the related components aligned with one another.

As shown in FIGS. 9 and 10, the present invention may also optionally utilize a tubular rigid sleeve 120 to positionally maintain the plural beverage containers in axial alignment with one another. The tubular sleeve 120 has a body 121 that has a first end portion 122 and a second end portion 123. The body 121 has an outer wall 124 that defines an exterior diameter 132 and has an outer circumferential surface 125 and an opposing inner circumferential surface 126 which defines a tubular chamber 129. The tubular chamber 129 defines an axial opening 127 at the first end portion 122, and defines a closed bottom 128 at the second end portion 123. The tubular chamber 129 defines an interior diameter 130 and an interior length 131. The interior length 131 is less than twice the length of a single beverage container.

Figure 6:
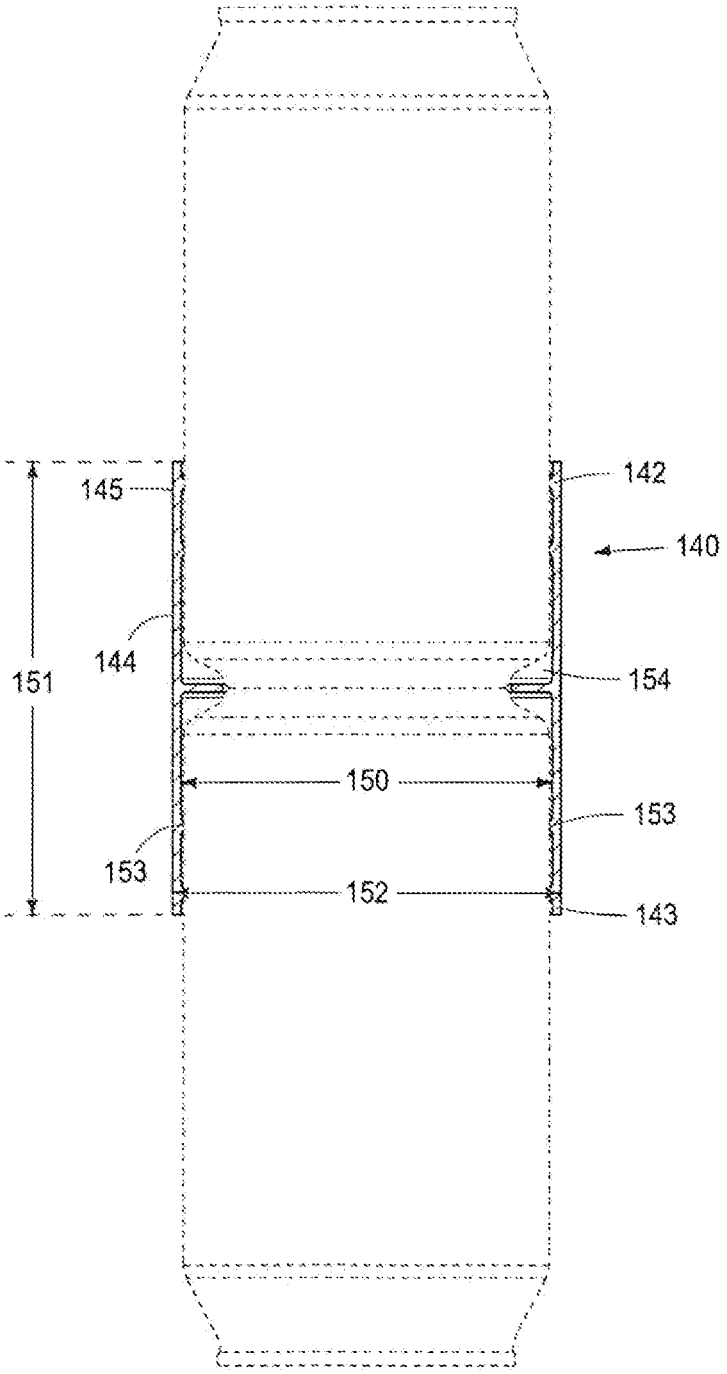
FIG. 6 is an orthographic, cross section, side view of two axially aligned beverage containers (in dashed outline) interconnected to one another with the connector boot, with one beverage container inverted, relative to the other beverage container
Figure 7:
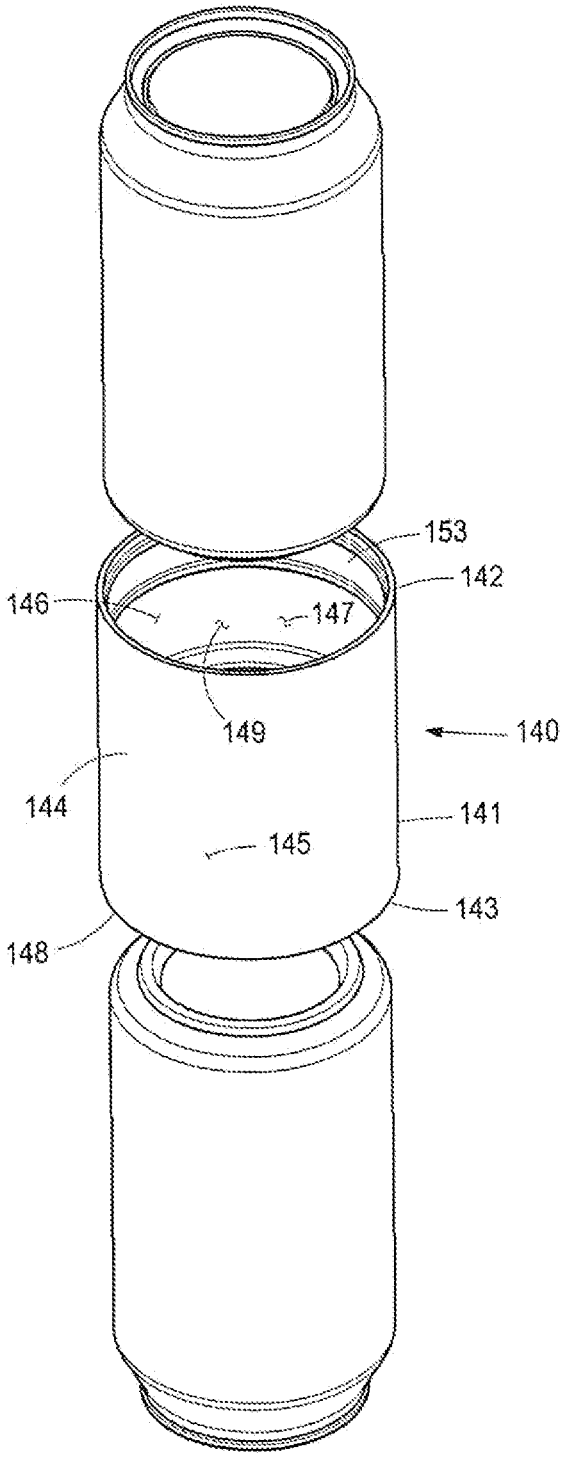
FIG. 7 is an exploded, perspective, side view of the two beverage containers and connector boot shown of FIG. 12.
Figure 8:
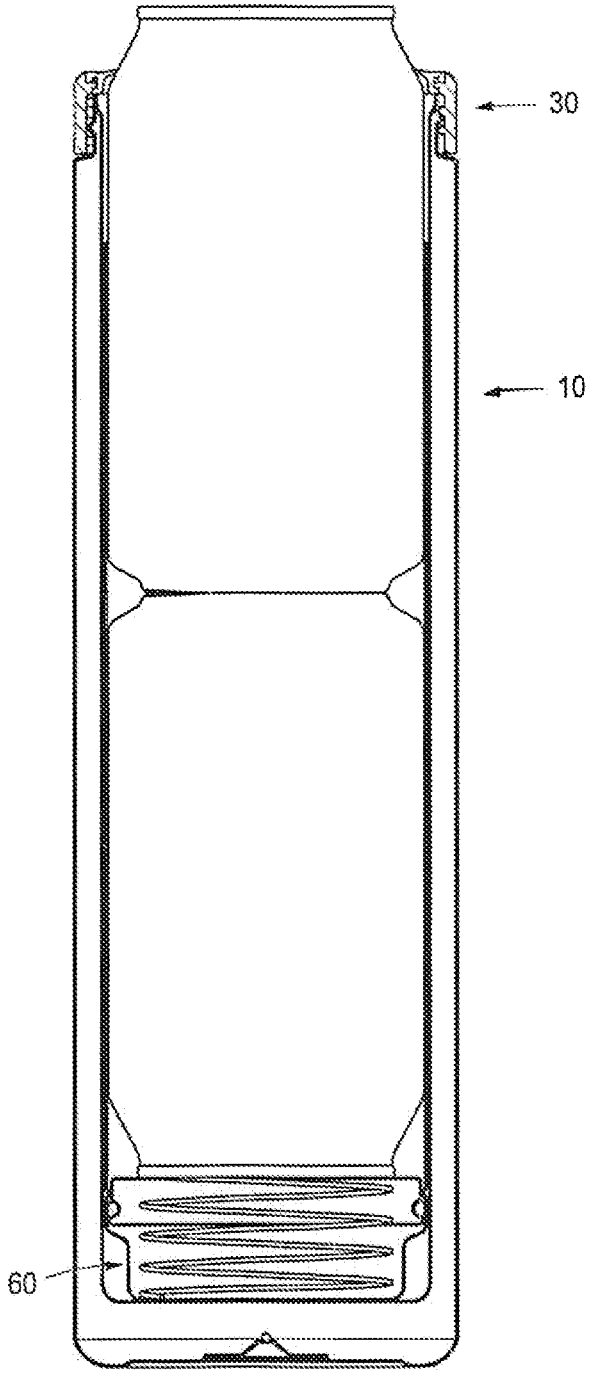
FIG. 8 is an orthographic, cross section, side view of the present invention, showing an embodiment of the puck in the second position, and the upper beverage container in a drinking/consumption position.

As shown in FIGS. 6 and 7, the present invention may also optionally utilize a flexible connector boot 140 that releasably interconnects to beverage containers to one another, one beverage container inverted, relative to the other beverage container. As shown in the Figures, the flexible connector boot 140 has a body 141 that has a first end portion 142 and an opposing second end portion 143. The body 141 has an outer circumferential surface 145 and an opposing inner circumferential surface 146. An axially aligned opening 147 is defined in the first end portion 142, and an axially aligned opening 148 is defined in the second end portion 143. Each of the axially aligned openings 147, 148 open to a tubular channel 149 that has a diameter 150, and a length 151. The tubular channel 149 carries a radially inwardly extending bulge 154 at a generally medial position in the tubular channel 149 to correctly space the interconnected beverage containers, and the tubular channel 149 further carries a plurality of radially inwardly extending webs 153 that frictionally engage with the beverage containers carried by the connector boot 140. The connector boot 140 further defines an exterior diameter 152 that is slightly less than the interior diameter 21 of the tubular chamber 20 of the body 10 so that plural beverage containers interconnected by the connector boot 140 are axially on movable within the tubular chamber 20 and may be secured therein by the puck 60 and the retention collar 30.

Operation

Having described the structure of my apparatus for containing, positioning and thermally insulating plural axially aligned beverage containers, its operation is briefly described.

To "load" beverage containers into the body 10, the body 10 is grasped by the user so that the opening 18 defined in the first end portion 11 is vertically above the second end portion 12. The user grasps a beverage container and axially aligns one end of the beverage container with the opening 18. The beverage container is axially "slid" into the tubular chamber 20. A second beverage container is similarly axially inserted into the tubular chamber 20 so that the two beverage containers are more fully contained within the tubular chamber 20 defined by the body 10. The puck 60 is placed within the opening 18 so that the puck 60 is partially within the tubular chamber 20, and partially extends axially outwardly from the tubular chamber 20 at the first end portion 11. The bottom exterior surface 81, carrying the fluid sealing gasket 88 there on frictionally communicates with the uppermost end of the uppermost beverage container within the tubular channel 20. The retention collar 30 is axially aligned with the puck 60 so that the puck 60 extends at least partially through the axially aligned hole 36 defined in the retention collar 30. The radially inwardly extending lip 37 and the flexible wiper 38 frictionally communicate with the puck 60 as the puck 60 partially passes into and through the axially aligned hole 36. The retention collar 30 is rotated axially so that the threads 35 defined in the retention collar 30 matingly engage with the threads 24 defined in the body 10 at the first end portion 11 of thereof. The threadable engagement of the retention collar 30 with the body 10 axially moves the puck 60 downwardly frictionally against the uppermost end portion of the uppermost beverage container to positionally secure the beverage containers within the tubular chamber 20. The cam lever 95 carried by the puck 60 is moved from the first position 110 into the second position 111 which responsively "draws" the second bottom portion 80 of the puck 60 closer to the first top portion 62 of the puck 60 which responsively compresses the O-ring gasket 105 between the upper gasket compressing ledge 69 and the lower gasket compressing ledge 85 which responsively causes the O-ring gasket 105 to expand radially outwardly to engage with the inner circumferential surface 16 of the tubular chamber 20 which responsively thermally seals the tubular chamber 20 and insulates the beverage containers within the tubular chamber.

When the user desires to consume a beverage from within one of the beverage containers, the user would reverse the above described process and remove both beverage containers from the tubular chamber 20. The puck 60, with the cam lever 95 in the first position 110 is placed within the tubular chamber 20 and allowed to "slide" axially downwardly therein so that the puck 60 rests frictionally against the interior bottom surface 26 of the tubular chamber 20. The beverage containers are then reinserted into the tubular chamber 20, as described previously. The retention collar 30 is again aligned with the beverage container that extends at least partially, axially outwardly from the first end portion 11 of the body 10. The retention collar 30 is thereupon axially rotated so as to threadably engage with the body 10. An upper end portion of the upper beverage container extends into and through the axially aligned hole 36 defined in the retention collar 30 so that the uppermost beverage container is accessible to a user for consumption. The radially inwardly extending lip 37 and the flexible wiper 38 frictionally engage with an outer circumferential surface of the beverage container to responsively positionally maintain the beverage container within the tubular chamber 20. When beverage within the first beverage container is fully consumed, the user may replace the consumed first beverage container with the second/lower beverage container that is not yet consumed by switching the positions of the two beverage containers, one, with the other.

If the user utilizes the rigid sleeve 120, the plural beverage containers are placed within the tubular chamber 129 of the rigid sleeve 120, and the rigid sleeve (containing the plural aligned beverage containers) is axially inserted into the tubular chamber 20 defined by the body 10 and is secured within the tubular chamber 20 as described above.

If the user utilizes the connector boot 140, the plural beverage containers are each engaged with one axial opening 147, 148 of the connector boot 140. It is preferable that the beverage containers are inverted, one relative to the other so that the portion of the beverage container that defines an opening for consumption of the beverage, is in a position opposite the connector boot 140. The plural beverage containers, and the connector boot 140 thereupon axially inserted into the tubular chamber 20 defined by the body 10. In the event the user intends to use both the connector boot 140 and the rigid sleeve 120, as plural beverage containers and the connector boot 140 are inserted into the tubular chamber 129 defined by the rigid sleeve 120. Thereafter, the rigid sleeve 120 which is carrying/containing the plural beverage containers and the connector boot 140 are axially inserted into the tubular chamber 20 defined by the body 10. In all instances, the retention collar 30 is used to secure the beverage containers within the body 10.

A principal object of the present invention is an apparatus for containing, positioning and thermally insulating plural axially aligned beverage containers, the apparatus comprising: a body 10 that is elongate and has a first end portion 11, a second end portion 12, and an exterior diameter 23, and an opening 18 defined at the first end portion 11 and a closed bottom 19 at the second end portion 12, the body 10 further defining a tubular chamber 20 that defines an interior diameter 21 and a length 22 between the opening 18 and an interior surface 26 of the closed bottom 19, and threads 24 are defined in an outer circumferential surface 14 at the first end portion 11; a retention collar 30 that is threadably engaged with the threads 24 defined in the first end portion 11 of the body 10, the retention collar 30 further defining and axially aligned hole 36 that has an interior diameter 39 that is smaller than the diameter 21 of the tubular chamber 20; a handle 50 carried on the outer circumferential surface 14 of the body 10; a puck 60 that is movable, by a user, between a first position adjacent to the opening 18, and a second position adjacent to the interior bottom surface 26, the puck 60 having a body 61 that has a first top portion 62 that has an upper gasket compressing ledge 69 and an interconnected second bottom portion 80 that has a lower gasket compressing ledge 85, and compressible gasket 105 between the upper gasket compressing ledge 69, and the lower gasket compressing ledge 85, and the first top portion 62 is movable relative to the second bottom portion 80 which responsively compresses the compressible gasket 105 and causes the compressible gasket 105 to expand radially outwardly so as to frictionally engage with an inner circumferential surface 16 of the tubular chamber 21 so as to positionally secure the puck 60 in an operator desired position.

A further object of the present invention is an apparatus for containing, positioning and thermally insulating plural axially aligned beverage containers, and wherein the first top portion 62 of the puck 60 is axially movable relative to the second bottom portion 80 of the puck 60, to cause the compressible gasket 105 to expand radially outwardly; and the movement of the first top portion 62, relative to the second bottom portion 80 is responsive to axial twisting, and engagement of mating threads 66 and 89 defined in the first top portion 62 and the second bottom portion 80.

A further object of the present invention is an apparatus for containing, positioning and thermally insulating plural axially aligned beverage containers, and wherein the first top portion 62 of the puck 60 is axially movable relative to the second bottom portion 80 of the puck 60, to cause the compressible gasket 105 to expand radially outwardly; and the movement of the first top portion 62, relative to the second bottom portion 80 is responsive to actuation of a cam lever 95.

A further object of the present invention is an apparatus for containing, positioning and thermally insulating plural axially aligned beverage containers, and wherein the handle 50 has a first end 51 that is secured to the outer circumferential surface 14 of the outer wall 13 body 10 proximate to the first end portion 11, and a second end 52 that is secured to the outer circumferential surface 14 of the outer wall 13 body 10 proximate to the second end portion 12, with the medial portion 53 between the first end 51 and the second end 52, and the medial portion 53 is resiliently flexible, and can be displaced radially relative to the outer circumferential surface 14 of the body 10.

A further object of the present invention is an apparatus for containing, positioning and thermally insulating plural axially aligned beverage containers and further comprising: an outer wall 13 of the body 10 defining an outer circumferential surface 14 and an exterior diameter 23; and an inner wall 15 of the body 10 defining an inner circumferential surface 16; and a void 17 between the outer wall 13 and the inner wall 15.

A further object of the present invention is an apparatus for containing, positioning and thermally insulating plural axially aligned beverage containers, and further comprising: insulation 25 in the void 17 between the outer wall 13 and the inner wall 15.

A further object of the present invention is an apparatus for containing, positioning and thermally insulating plural axially aligned beverage containers, and further comprising: a radially inwardly extending lip 37; and a radially inwardly extending flexible wiper 39 both carried by the retention collar 30 and within the axially aligned hole 36.

A further object of the present invention is an apparatus for containing, positioning and thermally insulating plural axially aligned beverage containers, further comprising: a fluid sealing gasket 88 carried on a bottom exterior surface 81 of the second bottom portion 80 to fluidically seal a beverage container adjacent to the bottom exterior surface 81.

A further object of the present invention is an apparatus for containing, positioning and thermally insulating plural axially aligned beverage containers, and further comprising: a sleeve 120 to positionally align and maintain two beverage containers, and wherein the sleeve 120 is tubular in configuration, the rigid sleeve 120 having a body 121 with a first end portion 122, a second end portion 123, an outer wall 124 having an outer circumferential surface 125, and defining a tubular chamber 129 that has an inner circumferential surface 126 and defines an axial opening 127 at the first end portion 122, and a closed bottom 128 at the second end portion 123, the body 121 having an exterior diameter 132, and the tubular chamber 129 defines an interior diameter 130 and an internal length 131; and wherein the exterior diameter 132 of the body 121 of the sleeve 120 is less than the diameter 21 of the tubular chamber 20 of the body 10, so that the sleeve 120 is axially receivable within the tubular chamber 20 of the body 10; and wherein the interior diameter 130 of the tubular channel 129 is greater than a diameter of the beverage containers, so that the beverage containers may be slidably carried within the tubular channel 129; and wherein the exterior diameter 132 of the sleeve 120, is greater than the diameter 39 of the axially aligned hole 36 defined in the retention collar 30, so that the retention collar 30 positionally maintains the sleeve 120 within the tubular chamber 20 of the body 10.

A further object of the present invention is an apparatus for containing, positioning and thermally insulating plural axially aligned beverage containers, and further comprising: a connector boot 140 that is generally tubular in configuration, the connector boot 140 having a body 141 with a first end portion 142 that defines an axial opening 147, a second end portion 143 that defines an axial opening 148, an outer wall 140 that defines an outer circumferential surface 145, and an exterior diameter 152, and a tubular channel 149 that extends between the first end portion 142 and the second end portion 143, the tubular channel 149 defining an interior diameter 150 and having a channel length 151, and plural spacedly arrayed radially inwardly extending webs 153 are carried on an inner circumferential surface 146 of the tubular channel 149 to frictionally engage with outer circumferential surfaces of axially aligned beverage containers that are simultaneously engaged within the axial openings 147, 148 of the connector boot 140, to positionally maintain the axially outlined beverage containers relative to the connector boot 140; and wherein the exterior diameter 152 of the connector boot 140 is less than the interior diameter 21 of the tubular chamber 20 of the body 10, so that the plural axially aligned beverage containers that are positionally maintained by the connector boot 140 can be axially movably carried within the tubular chamber 20 of the body 10.

A further object of the present invention is an apparatus for containing, positioning and thermally insulating plural axially aligned beverage containers and further comprising: a connector boot 140 that is generally tubular in configuration, the connector boot 140 having a body 141 with a first end portion 142 that defines an axial opening 147, a second end portion 143 that defines an axial opening 148, an outer wall 140 that defines an outer circumferential surface 145, and an exterior diameter 152, and a tubular channel 149 that extends between the first end portion 142 and the second end portion 143, the tubular channel 149 defining an interior diameter 150 and having a channel length 151, and plural spacedly arrayed radially inwardly extending webs 153 are carried on an inner circumferential surface 146 of the tubular channel 149 to frictionally engage with outer circumferential surfaces of axially aligned beverage containers that are simultaneously engaged within the axial openings 147, 148 of the connector boot 140, to positionally maintain the axially outlined beverage containers relative to the connector boot 140; and wherein the exterior diameter 152 of the connector boot 140 is less than the interior diameter 130 of the tubular chamber 129 of the sleeve 120, so that the plural axially aligned beverage containers that are positionally maintained by the connector boot 140 can be axially movably carried within the tubular chamber 129 of the sleeve 120.

A further object of the present invention is an apparatus for containing, positioning and thermally insulating plural axially aligned beverage containers, and further comprising: a thermal gel carried within the void 17 between the outer wall 13 and the inner wall 15 of the body 10.

A further object of the present invention is an apparatus for containing, positioning and thermally insulating plural axially aligned beverage containers, and wherein the puck 60 may be positioned, proximate to the first end portion 11 of the body so as to secure plural beverage containers within the tubular chamber 20, and the puck 60 may optionally be positioned within the tubular chamber 20 adjacent to the interior bottom surface 26 so that the beverage containers carried within the tubular chamber 20 are proximate to the first end portion 11 of the body, and are secured thereat by the retention collar 30, and a drink orifice defined in an upper-most beverage container is assessable to the user for dispensing of a beverage from within the beverage container.

A further object of the present invention is an apparatus for containing, positioning and thermally insulating plural axially aligned beverage containers and wherein the puck 60 is carried, at least partially, within the tubular chamber 20 of the body 10, and is movable by a user between a first position adjacent to the opening 18, of the body 10 and a second position adjacent to the interior bottom surface 26, the puck 60 having a body 61 that has a first top portion 62 and a second bottom portion 80 that is movable relative to the first top portion 62 and a cam lever 95; and wherein, the first top portion 62 of the puck 60 has a top exterior surface 63, an opposing bottom interior surface 73, an outer circumferential edge 68 that defines an upper gasket compressing ledge 69, and a cam lever hub 64 that is carried on the top exterior surface 63 and which defines diametrically opposed cam anchor axle slots 65 so that the cam lever 95 may extend therethrough and be pivotally moved relative to the first top portion 62, and the cam lever 95 is positioned within an annular shaped depression 67 defined in the top exterior surface 63 radially outwardly of the cam lever hub 64, and the bottom interior surface 73, of the first top portion 62, defines a medial chamber 72, a cam anchor passage 71, and an alignment boss 70 that extends generally axially downwardly from the bottom interior surface 73 about the medial chamber 72 and is tapered radially inwardly; and the second bottom portion 80 of the puck 60 has a top interior surface 89, a bottom exterior surface 81, an outer circumferential edge 84 that defines a lower gasket compressing ledge 85, and a recess 82 defined in the bottom exterior surface for a cam anchor 99, the second bottom portion 80 of the puck 60 further defining a medial chamber 86 that opens upwardly toward the first top portion 62, the top interior surface 89 carrying an annularly shaped, upwardly extending, radially inwardly tapered boss 87 that slidably cooperates with and aligns with the alignment boss 70 carried by the first top end portion 62, so that the first top portion 62 and the second bottom portion 80 are axially aligned relative to one another and are axially movable relative to one another, and a spring 74 is carried in the medial chamber 86 to positionally bias the first top portion 62 and the second bottom portion 80 distally from one another; and a compressible gasket 105 is carried by the puck 60 between the upper gasket compressing ledge 69 of the first top portion 62, and the lower gasket compressing ledge 85 of the second bottom portion 80; and the cam anchor 99 has a first end portion 100, a second end portion 101, a generally planar anchor disc 102 at the second end portion 101 and an axially extending anchor post 103 that is interconnected with the anchor disc 102 to extend toward the first end portion 100, and an end portion of the anchor post 103 opposite the disc 102 defines a cam engaging hook 104 that engages with a non-cylindrical cam axle 98 of the cam lever 95; and wherein the cam lever 95 is pivotally movable between a first position 110 and a second position 111 relative to the annular shaped depression 67 defined in the top exterior surface 63 and wherein, in the first position 110 the compressible gasket 105 positioned between the upper gasket compressing ledge 69, and the lower gasket compressing ledge 85 is not compressed, and the exterior diameter 78 of the puck 60 allows the puck 60 to move freely axially within the axially aligned tubular chamber 20, and when the cam lever 95 is in the second position 111, the compressible gasket 105 positioned between the upper gasket compressing ledge 69 and the lower gasket compressing ledge 85 is compressed which causes the fluid sealing gasket 88 to expand radially outwardly to have a second diameter 76 that is greater than the first diameter 78 which positionally secures the puck 60 at a desired position within the axially aligned tubular chamber 20, and seals the axially aligned tubular chamber 20.

A further object of the present invention is an apparatus for containing, positioning and thermally insulating plural axially aligned beverage containers, comprising: a body 10 that is elongate and generally cylindrical, having a first end portion 11, a second end portion 12, an outer wall 13 defining an outer circumferential surface 14 and defining an exterior diameter 23, an inner wall 15 defining an inner circumferential surface 16 with a void 17 between the outer wall 13 and the inner wall 15, and an axially aligned opening 18 defined at the first end portion 11 of the body 10 and a closed bottom 19 at the second end portion 12 of the body 10 spaced apart from the first end portion 11, the body 10 further defining an axially aligned tubular chamber 20 that defines an interior diameter 21, and a length 22 between the axially aligned opening 18 at the first end portion 11, and an interior surface 26 of the closed bottom 19 at the second end portion 12, and threads 24 are defined in the outer circumferential surface 14 of the outer wall 13 at the first end portion 11; a retention collar 30 that is annular in configuration and having a first end portion 31, a second end portion 32, an outer circumferential surface 33 and an inner circumferential surface 34 that defines threads 35 that matingly engage with the threads 24 defined in the outer circumferential surface 14 of the body 10 at the first end portion 11, the retention collar 30 further defining and axially aligned through hole 36 that defines an interior diameter 39 that is smaller than the diameter 21 of the axially aligned tubular chamber 20, and the axially aligned through hole 36 has a radially inwardly extending lip 37 and a radially inwardly extending flexible wiper 39; a handle 50 carried on the outer circumferential surface 14 of the body 10, the handle 50 having a first end 51 that is secured to the outer circumferential surface 14 of the outer wall 13 of the body 10 proximate to the first end portion 11, and a second end 52 that is secured to the outer circumferential surface 14 of the outer wall 13 of the body 10 proximate to the second end portion 12, with a medial portion 53 between the first end 51 and the second end 52, and the medial portion 53 is resiliently flexible and can be displaced radially outwardly from the outer wall 13 of the body 10; a puck 60 that is carried, at least partially, within the axially aligned tubular chamber 20 of the body 10, and is movable by a user between a first position adjacent to the opening 18, and a second position adjacent to the interior bottom surface 26, the puck 60 having a body 61 that defines an exterior diameter 78, and has a first top portion 62, a second bottom portion 80 that is movable relative to the first top portion 62, and a cam lever 95, and the first top portion 62 of the puck 60 has a top exterior surface 63, an opposing bottom interior surface 73, an outer circumferential edge 68 that defines an upper gasket compressing ledge 69, and a cam lever hub 64 that is carried on the top exterior surface 63 and which defines diametrically opposed cam anchor axle slots 65 so that the cam lever 95 may extend therethrough and be pivotally moved relative to the first top portion 62, and the cam lever 95 is positioned within an annular shaped depression 67 defined in the top exterior surface 63 radially outwardly of the cam lever hub 64, and the bottom interior surface 73, of the first top portion 62, defines a medial chamber 72, a cam anchor passage 71, and an alignment boss 70 that extends generally axially downwardly from the bottom interior surface 73 about the medial chamber 72 and is tapered radially inwardly, and the second bottom portion 80 of the puck 60 has a top interior surface 89, a bottom exterior surface 81, an outer circumferential edge 84 that defines a lower gasket compressing ledge 85, and a recess 82 defined in the bottom exterior surface for a cam anchor 99, the second bottom portion 80 of the puck 60 further defining a medial chamber 86 that opens upwardly toward the first top portion 62, the top interior surface 89 carrying an annularly shaped, upwardly extending, radially inwardly tapered boss 87 that slidably cooperates with and aligns with the alignment boss 70 carried by the first top end portion 62, so that the first top portion 62 and the second bottom portion 80 are axially aligned relative to one another and are axially movable relative to one another, and a spring 74 is carried in the medial chamber 86 to positionally bias the first top portion 62 and the second bottom portion 80 distally from one another, and a compressible gasket 105 is carried by the puck 60 between the upper gasket compressing ledge 69 of the first top portion 62, and the lower gasket compressing ledge 85 of the second bottom portion 80, and the cam anchor 99 has a first end portion 100, a second end portion 101, a generally planar anchor disc 102 at the second end portion 101 and an axially extending anchor post 103 that is interconnected with the anchor disc 102 to extend toward the first end portion 100, and an end portion of the anchor post 103 opposite the disc 102 defines a cam engaging hook 104 that engages with a non-cylindrical cam axle 98 of the cam lever 95; and wherein the cam lever 95 is pivotally movable between a first position 110 and a second position 111 relative to the annular shaped depression 67 defined in the top exterior surface 63 and wherein, in the first position 110 the compressible gasket 105 positioned between the upper gasket compressing ledge 69, and the lower gasket compressing ledge 85 is not compressed, and the exterior diameter 78 of the puck 60 allows the puck 60 to move freely axially within the axially aligned tubular chamber 20, and when the cam lever 95 is in the second position 111, the compressible gasket 105 positioned between the upper gasket compressing ledge 69 and the lower gasket compressing ledge 85 is compressed which causes the fluid sealing gasket 88 to expand radially outwardly to have a second diameter 76 that is greater than the first diameter 78 which positionally secures the puck 60 at a desired position within the axially aligned tubular chamber 20, and seals the axially aligned tubular chamber 20.

A still object aspect of the present invention is an apparatus for containing, positioning and thermally insulating plural axially aligned beverage containers and wherein length 22 of the axially aligned tubular chamber 20 of the body 10 is sufficient to fully enclose plural axially aligned beverage containers and the puck 60.

An even still object aspect of the present invention is an apparatus for containing, positioning and thermally insulating plural axially aligned beverage containers and wherein length 22 of the axially aligned tubular chamber 20 of the body 10 is sufficient to fully enclose two axially aligned beverage containers and the puck 60. [REMAINDER OF THIS PAGE INTENTIONALLY LEFT BLANK]

We claim:

1. An apparatus for containing, positioning and thermally insulating plural axially aligned beverage containers, the apparatus comprising:

a body that is elongate and has a first end portion, a second end portion, and an exterior diameter, and an opening defined at the first end portion and a closed bottom at the second end portion, the body further defining a tubular chamber that defines an interior diameter and a length between the opening and an interior surface of the closed bottom, and threads are defined in an outer circumferential surface at the first end portion;

a retention collar that threadably engages with the threads defined in the first end portion of the body, the retention collar further defining and axially aligned hole that has an interior diameter that is smaller than the interior diameter of the tubular chamber;

a puck that is axially movable within the tubular chamber between a first position adjacent to the opening defined at the first end portion of the body, and a second position completely within the tubular chamber and immediately adjacent to the interior bottom surface; and wherein the puck comprises a body that has a top portion and an interconnected bottom portion, and the top portion of the puck includes an upper gasket compressing ledge and the bottom portion of the puck includes a lower gasket compressing ledge; and a compressible gasket between the upper gasket compressing ledge and the lower gasket compressing ledge.

2. The apparatus as claimed in claim 1, and wherein the top portion is movable relative to the bottom portion which responsively compresses the compressible gasket and causes the compressible gasket to expand radially outwardly so as to frictionally engage with an inner circumferential surface of the tubular chamber so as to positionally secure the puck in place relative to the body.

3. The apparatus as claimed in claim 2, and wherein the movement of the top portion, relative to the bottom portion is responsive to axial twisting and engagement of mating threads defined in the top portion and the bottom portion of the puck.

4. The apparatus as claimed in claim 2, and wherein the movement of the top portion, relative to the bottom portion is responsive to actuation of a cam lever.

5. The apparatus as claimed in claim 1, and further comprising a handle carried on the outer circumferential surface of the body.

6. The apparatus as claimed in claim 1, and further comprising:

an outer wall of the body defining an outer circumferential surface and an exterior diameter; and an inner wall of the body defining an inner circumferential surface; and a void between the outer wall and the inner wall.

7. The apparatus as claimed in claim 6, and further comprising:

a thermally insulating material at least partially filling the void between the outer wall and the inner wall.

8. The apparatus as claimed in claim 1, and wherein the retention collar further comprising:

a radially inwardly extending lip; and a radially inwardly extending flexible wiper carried by the retention collar and within the axially aligned hole.

9. The apparatus as claimed in claim 1, and further comprising:

a rigid sleeve to positionally align and maintain a plurality of beverage containers, and wherein the rigid sleeve is tubular in configuration, the rigid sleeve having a body with a first end portion, a second end portion, an outer wall having an outer circumferential surface, and defining a tubular chamber that has an inner circumferential surface and defines an axial opening at the first end portion, and a closed bottom at the second end portion, the rigid sleeve body having an exterior diameter, and the rigid sleeve tubular chamber defines an interior diameter and an internal length; and wherein the exterior diameter of the rigid sleeve body is less than the diameter of the tubular chamber of the body, so that the rigid sleeve is axially receivable within the tubular chamber of the body; and wherein the interior diameter of the rigid sleeve tubular channel is greater than a diameter of each of the plurality of beverage containers, so that the plurality of beverage containers may be slidably carried within the rigid sleeve tubular channel; and wherein the rigid sleeve exterior diameter, is greater than the diameter of the axially aligned hole defined in the retention collar, so that the retention collar positionally maintains the rigid sleeve within the tubular chamber of the body.

10. The apparatus as claimed in claim 9, further comprising:

a flexible connector boot that is generally tubular in configuration, the connector boot having a boot body with a first end portion that defines a first axial opening, a second end portion that defines a second axial opening, an outer wall that defines an outer circumferential surface, and an exterior diameter, and a channel that extends between the first axial opening and the second axial opening of the boot body, the channel defining an interior diameter and having a channel length, and plural spacedly arrayed radially inwardly extending webs are carried on an inner circumferential surface of the boot body channel to frictionally engage with outer circumferential surfaces of axially aligned beverage containers that are simultaneously engaged within the first and second axial openings of the connector boot, to positionally maintain the axially aligned beverage containers relative to the connector boot; and wherein the exterior diameter of the connector boot is less than the interior diameter of the rigid sleeve tubular channel, so that the plurality of axially aligned beverage containers that are positionally maintained by the connector boot can be axially movably carried within the rigid sleeve tubular channel.

11. The apparatus as claimed in claim 1, and further comprising:

a flexible connector boot that is generally tubular in configuration, the connector boot having a boot body with a first end portion that defines a first axial opening, a second end portion that defines a second axial opening, an outer wall that defines an outer circumferential surface, and an exterior diameter, and a channel that extends between the first axial opening and the second axial opening of the boot body, the channel defining an interior diameter and having a channel length, and plural spacedly arrayed radially inwardly extending webs are carried on an inner circumferential surface of the boot body channel to frictionally engage with outer circumferential surfaces of axially aligned beverage containers that are simultaneously engaged within the first and second axial openings of the connector boot, to positionally maintain the axially aligned beverage containers relative to the connector boot; and wherein the exterior diameter of the connector boot is less than the interior diameter of the tubular chamber of the body, so that the plurality of axially aligned beverage containers that are positionally maintained by the connector boot can be received within the tubular chamber of the body.

12. The apparatus as claimed in claim 1, and wherein the puck may be positioned, proximate to the first end portion of the body so as to secure plural beverage containers within the tubular chamber, and the puck may optionally be positioned within the tubular chamber adjacent to the interior bottom surface so that the beverage containers carried within the tubular chamber are proximate to the first end portion of the body, and are secured thereat by the retention collar.

13. The apparatus as claimed in claim 1 and wherein the puck is carried, at least partially, within the tubular chamber of the body, and is movable by a user between a first position adjacent to the opening of the body and a second position adjacent to the interior bottom surface, the puck having a body that has a top portion and a bottom portion that is movable relative to the top portion and a cam lever; and wherein, the top portion of the puck has a top exterior surface, an opposing bottom interior surface, an outer circumferential edge that defines an upper gasket compressing ledge, and a cam lever hub that is carried on the top exterior surface and which defines diametrically opposed cam anchor axle slots so that the cam lever may extend therethrough and be pivotally moved relative to the top portion, and the cam lever is positioned within an annular shaped depression defined in the top exterior surface radially outwardly of the cam lever hub, and the bottom interior surface, of the top portion, defines a medial chamber, a cam anchor passage, and an alignment boss that extends generally axially downwardly from the bottom interior surface about the medial chamber and is tapered radially inwardly; and the bottom portion of the puck has a top interior surface, a bottom exterior surface, an outer circumferential edge that defines a lower gasket compressing ledge, and a recess defined in the bottom exterior surface for a cam anchor, the bottom portion of the puck further defining a medial chamber that opens upwardly toward the top portion, the top interior surface carrying an annularly shaped, upwardly extending, radially inwardly tapered boss that slidably cooperates with and aligns with the alignment boss carried by the first top end portion, so that the top portion and the bottom portion are axially aligned relative to one another and are axially movable relative to one another, and a spring is carried in the medial chamber to positionally bias the top portion and the bottom portion distally from one another; and a compressible gasket is carried by the puck between the upper gasket compressing ledge of the top portion, and the lower gasket compressing ledge of the bottom portion; and the cam anchor has a first end portion, a second end portion, a generally planar anchor disc at the second end portion and an axially extending anchor post that is interconnected with the anchor disc to extend toward the first end portion, and an end portion of the anchor post opposite the disc defines a cam engaging hook that engages with a non-cylindrical cam axle of the cam lever; and wherein the cam lever is pivotally movable between a first position and a second position relative to the annular shaped depression defined in the top exterior surface and wherein, in the first position the compressible gasket positioned between the upper gasket compressing ledge, and the lower gasket compressing ledge is not compressed, and the exterior diameter of the puck allows the puck to move freely axially within the axially aligned tubular chamber, and when the cam lever is in the second position, the compressible gasket positioned between the upper gasket compressing ledge and the lower gasket compressing ledge is compressed which causes the fluid sealing gasket to expand radially outwardly to have a second diameter that is greater than the first diameter which positionally secures the puck at a desired position within the axially aligned tubular chamber, and seals the axially aligned tubular chamber.

14. The apparatus as claimed in claim 1, and wherein length of the axially aligned tubular chamber of the body is sufficient to fully enclose plural axially aligned beverage containers and the puck.

15. An apparatus for containing, positioning and thermally insulating plural axially aligned beverage containers, the apparatus comprising:

a body that is elongate and has a first end portion, a second end portion, and an exterior diameter, and an opening defined at the first end portion and a closed bottom at the second end portion, the body further defining a tubular chamber that defines an interior diameter and a length between the opening and an interior surface of the closed bottom, and threads are defined in an outer circumferential surface at the first end portion;

a retention collar that threadably engages with the threads defined in the first end portion of the body, the retention collar further defining and axially aligned hole that has an interior diameter that is smaller than the interior diameter of the tubular chamber;

a puck that is axially movable within the tubular chamber between a first position adjacent to the opening defined at the first end portion of the body, and a second position completely within the tubular chamber and immediately adjacent to the interior bottom surface; and wherein the puck comprises a body that has a top portion and a bottom portion; and a fluid sealing gasket carried on the bottom portion of the puck to fluidically seal a beverage container adjacent to the bottom portion of the puck when the puck is in the first position.

16. An apparatus for containing, positioning and thermally insulating plural axially aligned beverage containers, the apparatus comprising:

a body that is elongate and has a first end portion, a second end portion, and an exterior diameter, and an opening defined at the first end portion and a closed bottom at the second end portion, the body further defining a tubular interior chamber that defines an inferior diameter and an interior length between the opening and an interior surface of the closed bottom, and threads are defined in an outer circumferential surface at the first end portion;

a retention collar that threadably engages with the threads defined in the first end portion of the body, the retention collar further defining and axially aligned hole that has an interior diameter that is smaller than the interior diameter of the tubular interior chamber;

a puck that is axially movable, within the tubular chamber, between a first position adjacent to the opening defined at the first end portion of the body, and a second position completely within the tubular chamber and adjacent to the interior bottom surface; and wherein the puck comprises a body, said body having a top portion that extends at least partially into and through the axially aligned hole defined in the retention collar, and said puck further has a bottom portion that is diametrically larger than said top portion, and said bottom portion is too large to pass into or through the axially aligned hole defined in the retention collar; and the puck fluidically seals the tubular chamber when the puck is engaged with both an upper-most beverage container within the tubular chamber and with the retention collar.

* * * * *